US009676215B2

(12) United States Patent
Yoshinaga et al.

(10) Patent No.: US 9,676,215 B2
(45) **Date of Patent: *Jun. 13, 2017**

(54) INKJET RECORDING APPARATUS THAT CONVEYS RECORDING MEDIUM WHILE APPLYING NEGATIVE PRESSURE

(71) Applicant: KYOCERA Document Solutions Inc., Osaka (JP)

(72) Inventors: Shinji Yoshinaga, Osaka (JP); Takeshi Watanabe, Osaka (JP); Hiroatsu Tamai, Osaka (JP); Satoshi Tsunemi, Osaka (JP); Hidenori Takenaka, Osaka (JP); Jumpei Hobo, Osaka (JP); Tomohisa Soda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/933,455

(22) Filed: Nov. 5, 2015

(65) Prior Publication Data

US 2016/0129712 A1 May 12, 2016

(30) Foreign Application Priority Data

Nov. 6, 2014 (JP) ..... 2014-226011

(51) Int. Cl.
*B41J 29/17* (2006.01)
*B41J 11/00* (2006.01)

(52) U.S. Cl.
CPC ..... *B41J 29/17* (2013.01); *B41J 11/007* (2013.01); *B41J 11/0085* (2013.01)

(58) Field of Classification Search
CPC ..... B41J 29/17; B41J 11/007; B41J 11/0085
See application file for complete search history.

(56) References Cited

U.S. PATENT DOCUMENTS 7,419,239 B2 * 9/2008 Brown ..... B41J 2/16552 347/10
9,427,979 B2 * 8/2016 Takenaka ..... B41J 2/2146
(Continued)

FOREIGN PATENT DOCUMENTS

JP 2005-169960 A 6/2005
JP 2008-213255 A 9/2008
(Continued)

OTHER PUBLICATIONS

An Office Action; "Notice of Reasons for Rejection," issued by the Japanese Patent Office on Aug. 30, 2016, which corresponds to Japanese Patent Application No. 2014-226011 and is related to U.S. Appl. No. 14/933,455.

*Primary Examiner* — Henok Legesse
(74) *Attorney, Agent, or Firm* — Studebaker & Brackett PC

(57) ABSTRACT

An inkjet recording apparatus includes a recording head, a conveyance section, a plate member, and a negative pressure applying section. The recording head ejects ink onto a recording medium. The conveyance section conveys the recording medium to a position of image forming by the recording head and has a conveying surface on which the recording medium is to be placed. The plate member is located upstream of the recording head in a conveyance direction of the recording medium to form a narrow gap with the conveying surface of the conveyance section. The negative pressure applying section applies negative pressure to the narrow gap. A distance across the narrow gap in a direction perpendicular to the conveying surface is set so as to allow air flowing into the narrow gap from surrounding space to have a higher flow velocity in the narrow gap than before flowing into the narrow gap.

20 Claims, 13 Drawing Sheets

(56) References Cited

U.S. PATENT DOCUMENTS

| | | | | |
|---|---|---|---|---|
| 2005/0128276 | A1 | 6/2005 | Yamada | |
| 2009/0244242 | A1* | 10/2009 | Sawada | B41J 11/0085 347/104 |
| 2011/0181639 | A1* | 7/2011 | Leoni | B41J 11/005 347/9 |
| 2016/0176211 | A1* | 6/2016 | Takenaka | B41J 11/0085 347/8 |
| 2016/0200121 | A1* | 7/2016 | Watanabe | B41J 11/007 347/16 |

FOREIGN PATENT DOCUMENTS

| | | | |
|---|---|---|---|
| JP | 2009-083512 | A | 4/2009 |
| JP | 2012-153048 | A | 8/2012 |

* cited by examiner

INKJET RECORDING APPARATUS THAT CONVEYS RECORDING MEDIUM WHILE APPLYING NEGATIVE PRESSURE

INCORPORATION BY REFERENCE

The present application claims priority under 35 U.S.C. §119 to Japanese Patent Application No. 2014-226011 filed on Nov. 6, 2014. The contents of this application are incorporated herein by reference in their entirety.

BACKGROUND

The present disclosure relates to inkjet recording apparatuses.

An inkjet apparatus that ejects ink onto a recording medium may address a problem of nozzle clogging in a recording head by adopting a known paper dust removal technique.

An inkjet recording apparatus of one known example is provided with a paper dust collector located upstream of a recording head in a conveyance direction of a recording medium. The paper dust collector has a vertical wall and a downstream wall. The vertical wall stands vertically upward. The downstream wall extends from the top end of the vertical wall in a downstream direction in the conveyance direction of the recording medium.

The paper dust collector collects paper dust generated during conveyance of the recording medium before the paper dust reaches the recording head. This reduces subsequent attachment of paper dust to the recording head.

SUMMARY

An inkjet recording apparatus according to the present disclosure includes a recording head, a conveyance section, a gap forming section, and a negative pressure applying section. The recording head ejects ink onto a recording medium. The conveyance section conveys the recording medium to a position of image forming by the recording head and has a conveying surface on which the recording medium is to be placed. The gap forming section is disposed upstream of the recording head in a conveyance direction of the recording medium to form a narrow gap with the conveying surface of the conveyance section. The negative pressure applying section applies negative pressure to the narrow gap. A distance across the narrow gap in a direction perpendicular to the conveying surface is set so as to allow air flowing into the narrow gap from surrounding space to have a higher flow velocity in the narrow gap than before flowing into the narrow gap.

BRIEF DESCRIPTION OF THE DRAWINGS

FIG. 8A showing a state in which a sheet P is standard paper; FIG. 8B showing a state in which the sheet P is thick paper; and FIG. 8C showing a state in which the sheet P is an envelope.

FIG. 9A showing a state in which a sheet P is standard paper; FIG. 9B showing a state in which the sheet P is thick paper; and FIG. 9C showing a state in which the sheet P is an envelope.

FIG. 10A showing a state in which a sheet P is standard paper; FIG. 10B showing a state in which the sheet P is thick paper; and FIG. 10C showing a state in which the sheet P is an envelope.

FIG. 12A showing a state in which the air blower is blowing air; and FIG. 12B showing a state in which air blower is not blowing air.

DETAILED DESCRIPTION

Figure 1:
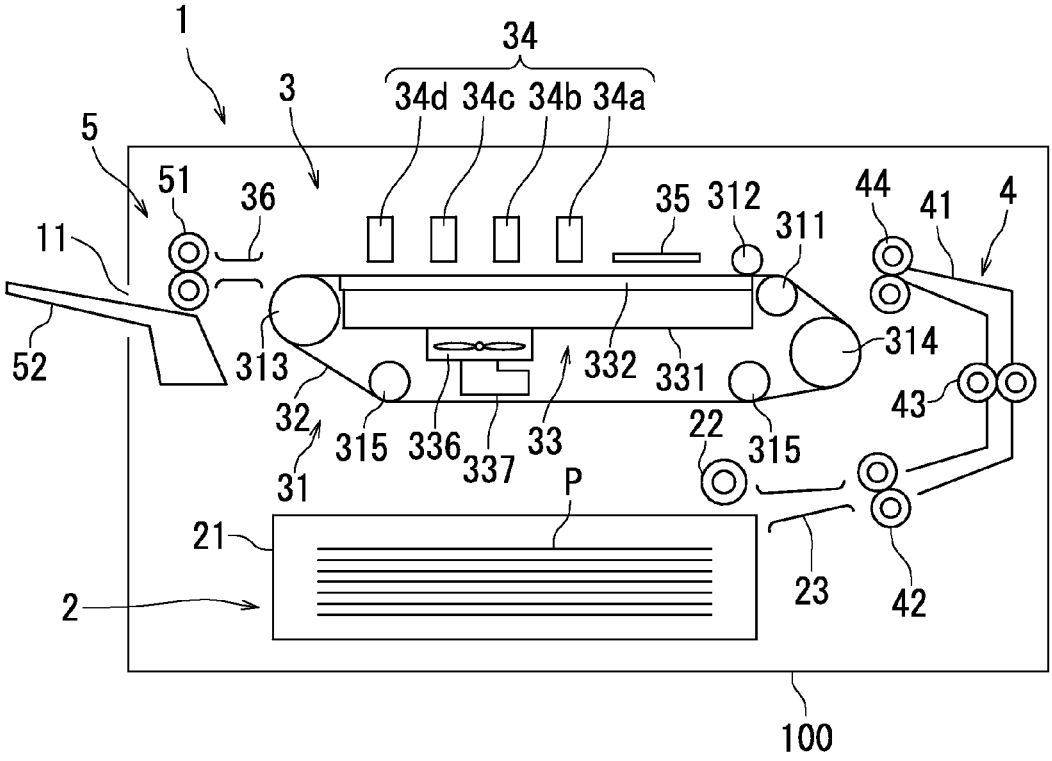
FIG. 1 shows structure of an inkjet recording apparatus according to an embodiment.

The following describes an embodiment of the present disclosure with reference to the accompanying drawings (FIGS. 1 to 13). In the figures, the like reference numerals represent similar components and explanation thereof is not repeated.

First, with reference to FIG. 1, an inkjet recording apparatus 1 according to the present embodiment is described. FIG. 1 shows structure of the inkjet recording apparatus 1 according to the present embodiment. The inkjet recording apparatus 1 includes an apparatus housing 100, a sheet feed section 2 located in a lower part of the apparatus housing 100, an image forming section 3 located above the sheet feed section 2, a sheet conveyance section 4 located at a side of the image forming section 3 (right side in FIG. 1), and a sheet ejecting section 5 located at the other side of the image forming section 3 (left side in FIG. 1).

The sheet feed section 2 includes a sheet feed cassette 21, a sheet feed roller 22, and a guide plate 23. The sheet feed cassette 21 is for storing recording sheets P and is attachable to and detachable from the apparatus housing 100. The sheet feed roller 22 is located above one end of the sheet feed cassette 21 (right end in FIG. 1). The guide plate 23 extends between the sheet feed roller 22 and the sheet conveyance section 4.

The sheet feed cassette 21 is loaded with a plurality of recording sheets P. In the following description, a recording sheet P is referred to simply as a sheet P. A sheet P is an example of a "recording medium". The sheet feed roller (pickup roller) 22 feeds sheets P one at a time in the conveyance direction of the sheet P by picking up the uppermost sheet P among the sheets P stored in the sheet feed cassette 21. The guide plate 23 guides the sheet P picked up by the sheet feed roller 22 to the sheet conveyance section 4.

The sheet conveyance section 4 includes a sheet conveyance path 41 substantially defining a C-shape, a pair of first conveyance rollers 42 located at the entry of the sheet conveyance path 41, a pair of second conveyance rollers 43 located at an intermediate location on the sheet conveyance path 41, and a pair of registration rollers 44 located at the exit of the sheet conveyance path 41.

The pair of first conveyance rollers 42 is a pair of rollers (a pair of feed rollers) that feeds a sheet P in the conveyance direction of the sheet P. The sheet P fed from the sheet feed section 2 is caught between the first conveyance rollers 42 and forwarded to the sheet conveyance path 41. Also, the pair of second conveyance rollers 43 is a pair of feed rollers. The sheet P forwarded from the pair of first conveyance rollers 42 is caught between the pair of second conveyance rollers 43 and forwarded toward the pair of registration rollers 44.

The pair of registration rollers 44 performs skew correction on the sheet P having been conveyed by the second conveyance rollers 43. The pair of registration rollers 44 temporarily holds the sheet P to synchronize the conveyance of the sheet P and image forming, and then feeds the sheet P to the image forming section 3 according to timing of the image formation.

The image forming section 3 includes a conveyor belt 32 and recording heads 34. The conveyor belt 32 conveys the sheet P fed from the pair of registration rollers 44 in a predetermined direction (leftward in FIG. 1). The recording heads 34 form an image on the sheet P being conveyed on the conveyor belt 32. Detailed structure of the image forming section 3 is described later with reference to FIG. 2. The image forming section 3 additionally includes a conveyance guide 36 located downstream (to the left in FIG. 1) of the recording heads 34 in the conveyance direction of the sheet P.

Once the sheet P is conveyed from the conveyor belt 32, the conveyance guide 36 guides the sheet P to the sheet ejecting section 5. The sheet ejecting section 5 includes a pair of ejection rollers 51 and an exit tray 52. The exit tray 52 is secured to the apparatus housing 100 so as to protrude outward from an exit port 11 formed in the apparatus housing 100.

The pair of ejection rollers 51 forwards the sheet P toward the exit port 11 after the sheet P passes through the conveyance guide 36. The exit tray 52 guides the sheet P ejected by the pair of ejection rollers 51. The sheet P is ejected out of the apparatus housing 100 by the pair of ejection rollers 51 through the exit port 11 formed in a side surface of the apparatus housing 100 (a left side surface in FIG. 1). The sheet P ejected through the exit port 11 is stacked in the exit tray 52.

Figure 2:
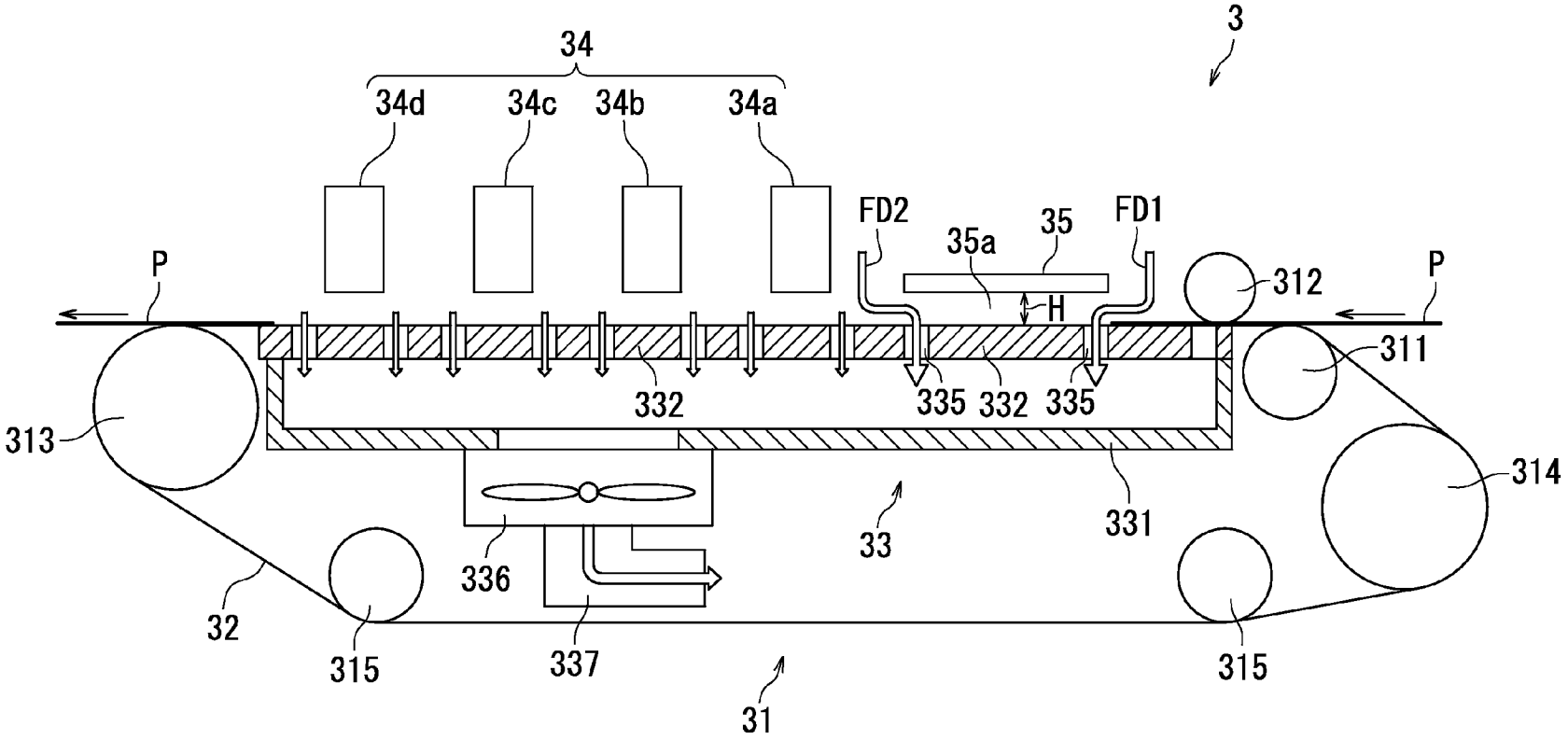
FIG. 2 shows structure of an image forming section shown in FIG. 1.

Next, a description is given of the image forming section 3 with reference to FIG. 2. FIG. 2 shows structure of the image forming section 3 shown in FIG. 1.

As shown in FIG. 2, the image forming section 3 includes a conveyance section 31, a negative pressure applying section 33, the recording heads 34, and a plate member 35. The recording heads 34, which specifically are four recording heads 34*a*, 34*b*, 34*c*, and 34*d*, each include a plurality of nozzles (not shown). Ink is ejected through the plurality of nozzles so as to form images such as characters and figures on a sheet P. The recording heads 34*a*, 34*b*, 34*c*, and 34*d* are substantially identical in structure and may therefore be generally referred to as recording heads 34 without distinguishing therebetween.

The conveyance section 31 conveys a sheet P in a predetermined direction (leftward in FIG. 2) and includes a belt speed detecting roller 311, a placing roller 312, a drive roller 313, a tension roller 314, a pair of guide rollers 315, and the conveyor belt 32.

The conveyance section 31 is located opposite to the four recording heads 34 (34*a*, 34*b*, 34*c*, and 34*d*) in the apparatus housing 100. The conveyor belt 32 is stretched around the belt speed detecting roller 311, the drive roller 313, the tension roller 314, and the pair of guide rollers 315. The conveyor belt 32 is driven to circulate in the conveyance direction of the sheet P (counterclockwise in FIG. 2) to convey the sheet P. The conveyor belt 32 is an example of an "endless belt".

The tension roller 314 tensions the conveyor belt 32 in order to prevent sagging of the conveyor belt 32.

The belt speed detecting roller 311 is located upstream (to the right in FIG. 2) of the negative pressure applying section 33 in the conveyance direction of the sheet P and rotates by friction with the conveyor belt 32. The belt speed detecting roller 311 includes a pulse plate (not shown) that integrally rotates with the belt speed detecting roller 311. The rotational speed of the conveyor belt 32 is measured by measuring the rotational speed of the pulse plate.

The drive roller 313 is located downstream (to the left in FIG. 1) of the negative pressure applying section 33 in the conveyance direction of the sheet P. The drive roller 313 is preferably located in cooperating relation with the belt speed detecting roller 311 so as to ensure the flatness of the conveyor belt 32 at regions opposite to the recording heads 34.

The drive roller 313 is driven to rotate by a motor (not shown) to circulate the conveyor belt 32 counterclockwise in FIG. 2.

The pair of guide rollers 315 is located below the negative pressure applying section 33 to secure space below the negative pressure applying section 33. This arrangement prevents a portion of the conveyor belt 32 below the negative pressure applying section 33 from contacting the negative pressure applying section 33.

The four recording heads 34 (34*a*, 34*b*, 34*c*, and 34*d*) are arranged in order from upstream to downstream in the conveyance direction of the sheet P. The recording heads 34*a*, 34*b*, 34*c*, and 34*d* each include a plurality of nozzles (not shown) arranged in a width direction of the conveyor belt 32 (direction perpendicular to the drawing surface in FIG. 2). The recording heads 34*a*, 34*b*, 34*c*, and 34*d* are referred to as a line type recording heads. This follows that the inkjet recording apparatus 1 is a line head inkjet recording apparatus.

The negative pressure applying section 33 applies negative pressure to the sheet P through the conveyor belt 32, causing the sheet P to be sucked onto the conveyor belt 32. The negative pressure applying section 33 is located on the rear surface (underside in FIG. 2) of the conveyor belt 32 and opposite to the four recording heads 34 with the conveyor belt 32 therebetween. The negative pressure applying section 33 includes an airflow chamber 331 that is open at the top, a guide member 332 that closes the open top of the airflow chamber 331, a negative pressure creating section 336, and a gas outlet 337.

The placing roller 312 is a driven roller. The placing roller 312 is located opposite to the guide member 332 with the conveyor belt 32 therebetween. The placing roller 312 guides a sheet P that has been fed from the pair of registration rollers 44 onto the conveyor belt 32 so that the sheet P is sucked onto the conveyor belt 32.

The guide member 332 supports the sheet P through the conveyor belt 32. The guide member 332 is an example of a "conveyor plate". The guide member 332 has through holes 335 and is formed from, for example, a metallic material. Specifically, for example, the guide member 332 may be made of die-cast aluminum or a pressed metal plate. Alternatively, the guide member 332 may be made of resin to provide excellent slidability of the guide member 332 against the conveyor belt 32.

For convenience, the present embodiment describes the guide member 332 as part of the negative pressure applying section 33. Alternatively, however, the guide member 332 may be described as part of the conveyance section 31 because the guide member 332 supports the conveyor belt 32 as described above.

The airflow chamber 331 is a box-shaped member that is a tube having an open top and a closed bottom. The airflow chamber 331 has side walls that are secured at the top to the guide member 332. The negative pressure creating section 336 is located under the airflow chamber 331. The bottom wall of the box-shaped member forming the airflow chamber 331 has the gas outlet 337 located downstream of (under in FIG. 2) the negative pressure creating section 336 in the direction of airflow. Through the drive of the negative pressure creating section 336, negative pressure is created in the airflow chamber 331. The negative pressure acts on the sheet P through the guide member 332 and the conveyor belt 32 to suck the sheet P onto the conveyor belt 32.

The negative pressure creating section 336 creates negative pressure in the airflow chamber 331, and may for example be a fan. However, the negative pressure creating section 336 is not limited to being a fan and may for example be a vacuum pump instead.

The plate member 35 is located upstream of the recording heads 34 in the conveyance direction of the sheet P (to the right in FIG. 2). In other words, the plate member 35 is located between the recording head 34*a* and the placing roller 312. The plate member 35 corresponds to part of a "gap forming section". A gap present between the lower surface of the plate member 35 and the upper surface of the conveyor belt 32 is a narrow gap 35*a*, which will be described later.

Next, a description is given of operation of the inkjet recording apparatus 1 with reference to FIG. 1. First, the sheet feed roller 22 picks up a sheet P from the sheet feed cassette 21. The sheet P is then guided by the guide plate 23 to the pair of first conveyance rollers 42.

The sheet P is fed by the pair of first conveyance rollers 42 into the sheet conveyance path 41 and then conveyed by the pair of second conveyance rollers 43 in the conveyance direction of the sheet P. The sheet P comes to stop upon contact with the pair of registration rollers 44 where skew correction of the sheet P is performed. The sheet P is subsequently fed to the image forming section 3 by the pair of registration rollers 44 in synchronization with timing of image formation.

The sheet P is guided to the conveyor belt 32 by the placing roller 312 and sucked onto the conveyor belt 32. Preferably, the sheet P is guided to the conveyor belt 32 such that the widthwise center of the sheet P coincides with the widthwise center of the conveyor belt 32. The sheet P covers some of suction holes 321 (see FIG. 4) in the conveyor belt 32. The negative pressure applying section 33 sucks air through the guide member 332 and the conveyor belt 32. That is, the negative pressure applying section 33 creates negative pressure in the airflow chamber 331. The negative pressure acts on the sheet P and thus the sheet P is sucked onto the conveyor belt 32. The sheet P is conveyed in the sheet conveyance direction as the conveyor belt 32 circulates.

The sheet P is then conveyed on the conveyor belt 32 sequentially to the regions opposite to the four recording heads 34*a*, 34*b*, 34*c*, and 34*d*. While the sheet P is conveyed on the conveyor belt 32, the four recording heads 34*a*, 34*b*, 34*c*, and 34*d* eject ink of respective colors toward the sheet P. This forms an image on the sheet P.

The sheet P is conveyed from the conveyor belt 32 to the conveyance guide 36. Once passed through the conveyance guide 36, the sheet P is fed toward the exit port 11 by the pair of ejection rollers 51 and ejected through the exit port 11 to be guided along the exit tray 52 out of the apparatus housing 100.

Figure 3:
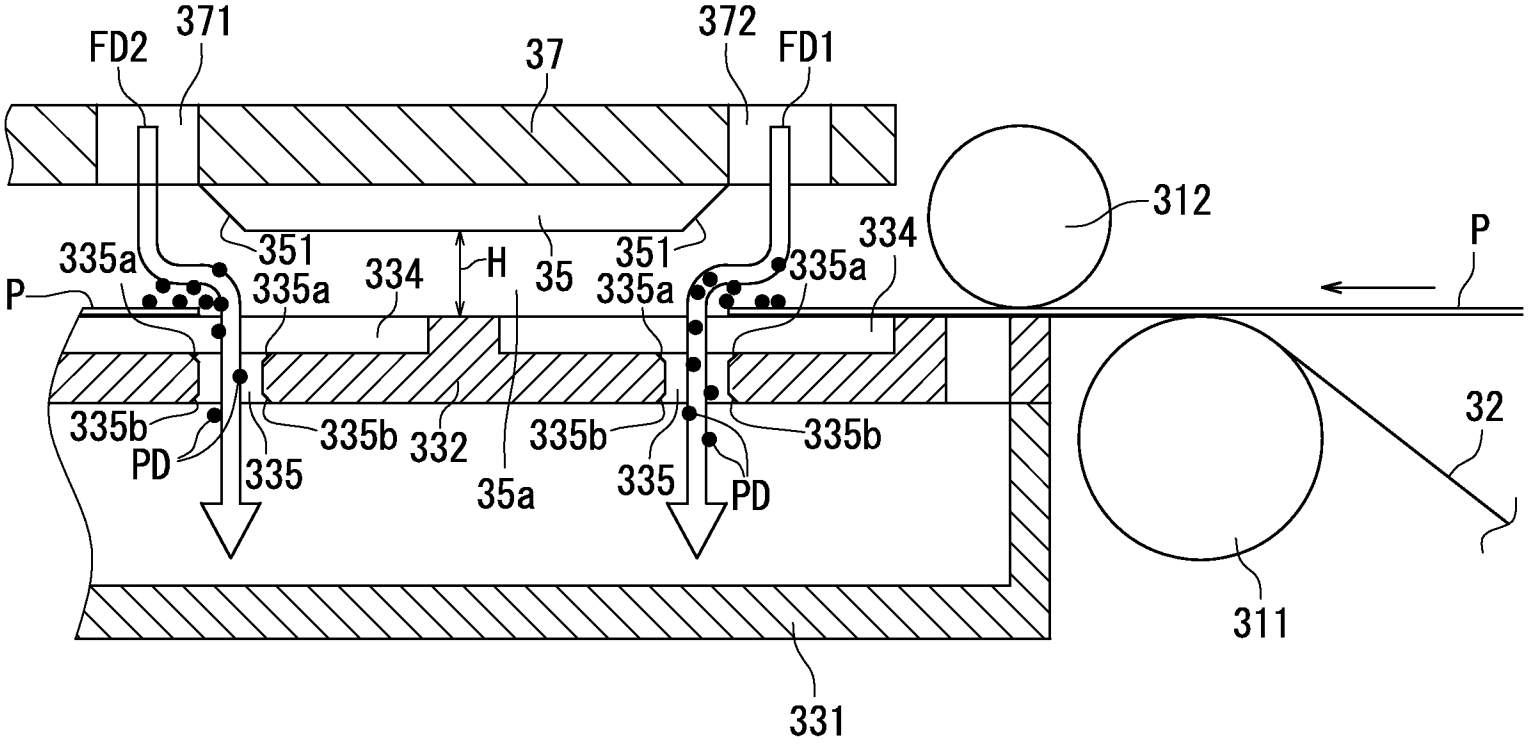
FIG. 3 shows structure around a plate member shown in FIG. 2.

Next, a description is given of structure around the plate member 35 with reference to FIG. 3. FIG. 3 shows structure around the plate member 35 shown in FIG. 2.

As shown in FIG. 3, the plate member 35 is secured to a head base 37. The head base 37 is a plate-like member for securing the recording head 34 in place. The head base 37 corresponds to part of the "gap forming section". A distance H across the narrow gap 35*a* in a direction perpendicular to the upper surface of the conveyor belt 32 is set so as to allow air flowing into the narrow gap 35*a* from surrounding space to have a higher flow velocity in the narrow gap 35*a* than before flowing into the narrow gap 35*a*. In other words, the distance H is a vertical length (distance) of the narrow gap 35*a*. Specifically, the narrow gap 35*a* is formed between the lower surface of the plate member 35 and the upper surface of the conveyor belt 32 such that the vertical distance H is equal to or shorter than a threshold distance HS that is set in advance (for example, 3 mm). At least the lower surface of the plate member 35 is formed from an electrical conductor (metal such as stainless steel) that is earthed. The upper surface of part of the conveyor belt 32 that is contact with the guide member 332 is an example of a "conveying surface". According to the present embodiment, the vertical distance H across the narrow gap 35*a* measures, for example, 2 mm.

The description given above with reference to FIG. 3 is directed to a situation in which the sheet P is sufficiently thin relative to the vertical distance H across the narrow gap 35*a*. Preferably, the vertical distance H across the narrow gap 35*a* is adjusted according to the thickness of the sheet P as described later with reference to FIGS. 8A to 10C. Specifically, for example, it is preferable to lift the plate member 35 up and down according to the thickness of the sheet P to keep the distance between the upper surface of the sheet P and the lower surface of the plate member 35 substantially constant (for example, 2 mm).

The head base 37 has holes 371 and 372 for allowing air to flow into the narrow gap 35*a*. The hole 371 is located downstream (to the left in FIG. 3) of the plate member 35 in the conveyance direction of the sheet P, and the hole 372 is located upstream (to the right in FIG. 3). The holes 371 and 372 are elongated in the width direction of the sheet P (direction perpendicular to the drawing surface of FIG. 3).

The present embodiment is directed to a configuration in which the head base 37 has the holes 371 and 372 elongated in the width direction of the sheet P. Alternatively, however, the head base 37 may have holes having a different shape. The head base 37 may for example have a plurality of substantially cylindrical holes arranged in the width direction of the sheet P.

The holes 371 and 372 in the head base 37 allow air to flow into the narrow gap 35*a* and then into the airflow chamber 331 sequentially through the suction holes 321 (see FIG. 4) in the conveyor belt 32 and the through holes 335 in the guide member 332. In other words, the airflow chamber 331 is under negative pressure created by the negative pressure creating section 336 (for example, at a pressure differing from the standard atmosphere by about 0.005 atm≈about 500 Pa). Therefore, air present in the narrow gap 35*a* is drawn into the airflow chamber 331 sequentially through the suction holes 321 in the conveyor belt 32 and the through holes 335 in the guide member 332. In addition, as air is drawn out of the narrow gap 35*a* to the airflow chamber 331, air is drawn into the narrow gap 35*a* through the holes 371 and 372 in the head base 37.

As described above, air flows along paths indicated by arrows FD1 and FD2 shown in FIG. 3. In addition, the vertical distance H across the narrow gap 35*a* is set to be equal to or shorter than the threshold distance HS that is set in advance. Consequently, the flow velocity increases in the narrow gap 35*a*. The flow velocity in the narrow gap 35*a* is preferably at least 6.0 m/sec, for example.

As described above, air blowing along the path indicated by the arrow FD1 flows from upstream to downstream in the conveyance direction of the sheet P in the narrow gap 35*a* (to the left in FIG. 3). Consequently, as shown in FIG. 3, paper dust PD attached to the leading edge (left edge in FIG. 3) of the sheet P is removed and collected into the airflow chamber 331. In addition, air blowing along the path indicated by the arrow FD2 flows from downstream to upstream in the conveyance direction of the sheet P in the narrow gap 35*a* (to the right in FIG. 3). Consequently, as shown in FIG. 3, paper dust PD attached to the trailing edge (right edge in FIG. 3) of the sheet P is removed and collected into the airflow chamber 331. This can ensure effective removal of paper dust attached to the sheet P.

As described above, in addition, the plate member 35 is formed at least partly from an earthed electrical conductor and thus will not be charged. Therefore, the plate member 35 can be ensured not to attract paper dust even though the paper dust may be charged.

As described above, attachment of the plate member 35 can be facilitated by securing the plate member 35 to the head base 37. In addition, the head base 37 has the holes 371 and 372 allowing air to flow into the narrow gap 35*a* and thus is able to ensure smooth flow of air into the narrow gap 35*a*.

The present embodiment is directed to a configuration in which the plate member 35 is secured to the head base 37. Alternatively, however, the plate member 35 may be secured to the apparatus housing 100 shown in FIG. 1. For example, the apparatus housing 100 may be provided with a securing member extended therefrom to hold the plate member 35 at opposite ends in the width direction of the plate member 35 (direction perpendicular to the drawing surface of FIG. 3). In this configuration, no component member obstructs air flowing into the narrow gap 35*a* from a downstream side and an upstream side in the conveyance direction of the sheet P. Therefore, the flow velocity of air in the narrow gap 35*a* can increase to a greater extent. Consequently, paper dust can be removed more effectively.

As shown in FIG. 3, the plate member 35 has tapered portions 351 such that the distance across the narrow gap 35*a* in the direction perpendicular to the upper surface of the conveyor belt 32 is greater toward either edge of the plate member 35 in the conveyance direction of the sheet P (horizontal direction in FIG. 3). Specifically, one of the tapered portions 351 that is on the right in FIG. 3 is formed such that the distance across the narrow gap 35*a* in the direction perpendicular to the upper surface of the conveyor belt 32 is greater toward the upstream edge of the plate member 35 in the conveyance direction of the sheet P (the horizontal direction in FIG. 3). Similarly, one of the tapered portions 351 that is on the left in FIG. 3 is formed such that the distance across the narrow gap 35*a* in the direction perpendicular to the upper surface of the conveyor belt 32 is greater toward the downstream edge of the plate member 35 in the conveyance direction of the sheet P (the horizontal direction in FIG. 3). In other words, the tapered portions 351 are formed at an upstream end and a downstream end of the plate member 35 in the conveyance direction of the sheet P such that the plate member 35 is thinner toward either edge of the plate member 35 in the conveyance direction of the sheet P.

As described above, the plate member 35 is provided with the tapered portions 351 such that the distance across the narrow gap 35*a* in the direction perpendicular to the upper surface of the conveyor belt 32 is greater toward either edge of the plate member 35 in the conveyance direction of the sheet P (the horizontal direction in FIG. 3). This configuration enables to reduce pressure loss of air flowing along the plate member 35. Therefore, the flow velocity of air in the narrow gap 35*a* can increase to remove paper dust even more effectively.

Figure 4:
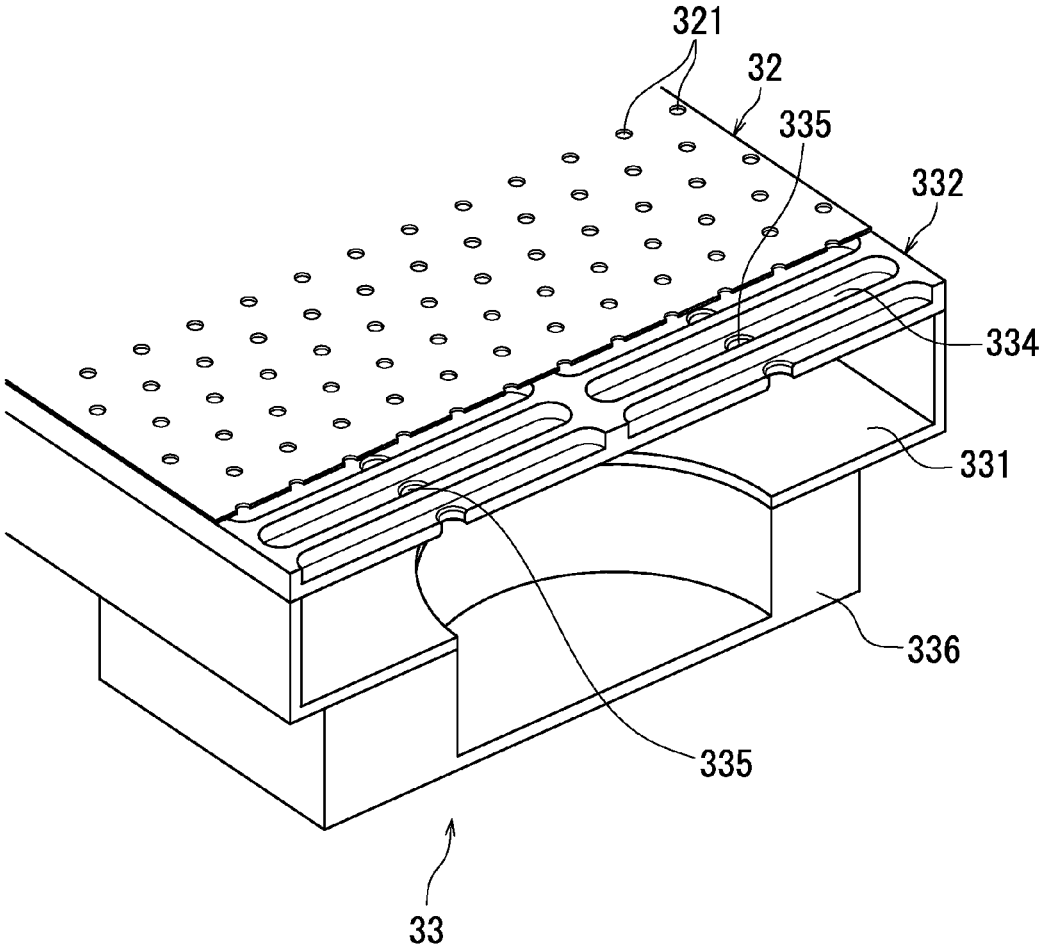
FIG. 4 is a cross sectional perspective view showing structure of a conveyor belt, a guide member, and a negative pressure applying section shown in FIG. 2.

Next, a description is given of structure of the conveyor belt 32, the guide member 332, and the negative pressure applying section 33, with reference to FIG. 4. FIG. 4 is a cross sectional perspective view showing the structure of the conveyor belt 32, the guide member 332, and the negative pressure applying section 33.

As shown in FIG. 4, the conveyor belt 32, the guide member 332, the airflow chamber 331, and the negative pressure creating section 336 are located in order from top to bottom. The conveyor belt 32 has a plurality of suction holes 321 perforated therethrough.

The following describes the suction holes 321 in the conveyor belt 32. As shown in FIG. 4, the suction holes 321 are formed in the conveyor belt 32 at substantially equal intervals. The suction holes 321 each have a diameter of, for example, 2 mm. The spacing between adjacent suction holes 321 is, for example, 8 mm.

The guide member 332 has a plurality of grooves 334 in the upper surface (surface facing toward the conveyor belt 32). The grooves 334 have a shape of an oval elongated in the conveyance direction of the sheet P.

Figure 5:
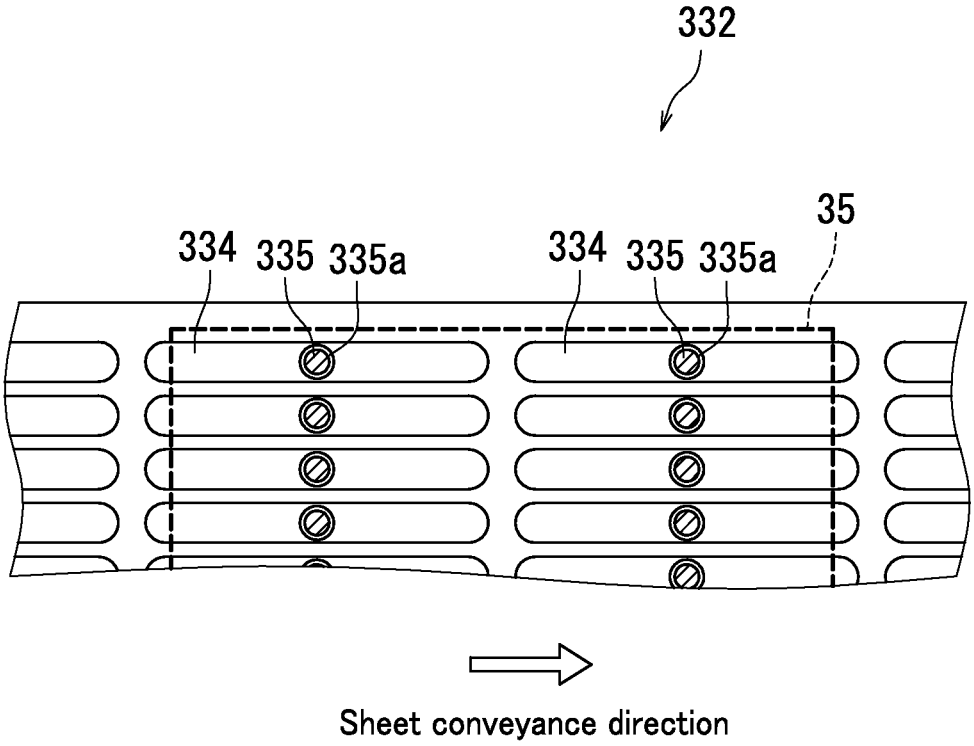
FIG. 5 is a plan view showing structure of the guide member shown in FIG. 4.

With reference to FIG. 5, the following describes the grooves 334 and the through holes 335 formed in the guide member 332. FIG. 5 is a plan view showing structure of the guide member 332 shown in FIG. 4. As shown in FIG. 5, the guide member 332 has the grooves 334 each having a shape of an oval elongated in the conveyance direction of the sheet P (horizontal direction in FIG. 5). The grooves 334 are arranged in a plurality of rows that are next to one another in the width direction of the guide member 332 (vertical direction in FIG. 5). Each groove 334 has a through hole 335 that penetrates the guide member 332 in the thickness direction thereof substantially at the center of the groove 334 in the conveyance direction of the sheet P (horizontal direction in FIG. 5). Each through hole 335 is substantially circular in cross section.

FIG. 5 shows, in dashed lines, a projected position of the plate member 35 on the guide member 332. The projected image of the plate member 35 on the guide member 332 overlaps with two columns of through holes 335, one at an upstream side in the conveyance direction of the sheet P (left in FIG. 5) and the other at a downstream side (right in FIG. 5). The grooves 334 containing the through holes 335 that are in the upstream column in the conveyance direction of the sheet P (to the left in FIG. 5) each extend further upstream beyond the upstream edge (left edge in FIG. 5) of the projected image of the plate member 35. Similarly, the grooves 334 containing the through holes 335 that are in the downstream column in the sheet conveyance direction (to the right in FIG. 5) each extend further downstream beyond the downstream edge (right edge in FIG. 5) of the projected image of the plate member 35.

Figure 6A:
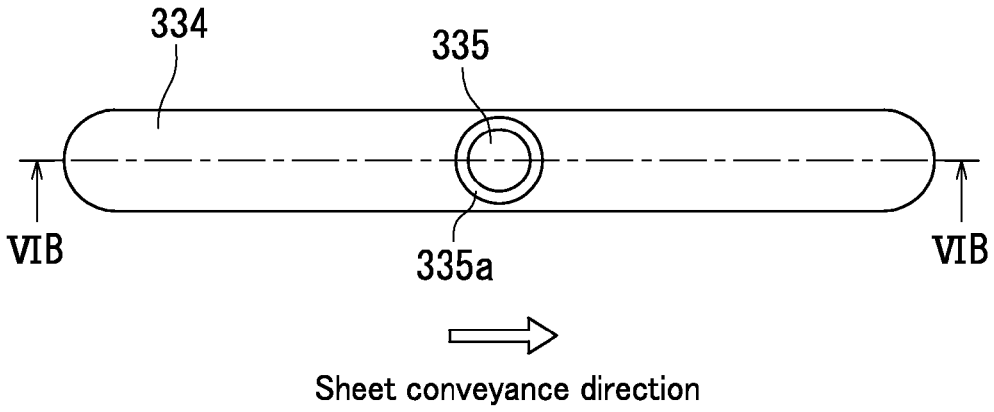
FIG. 6A is a plan view showing structure of a groove and a through hole formed in the guide member shown in FIG. 5.
Figure 6B:
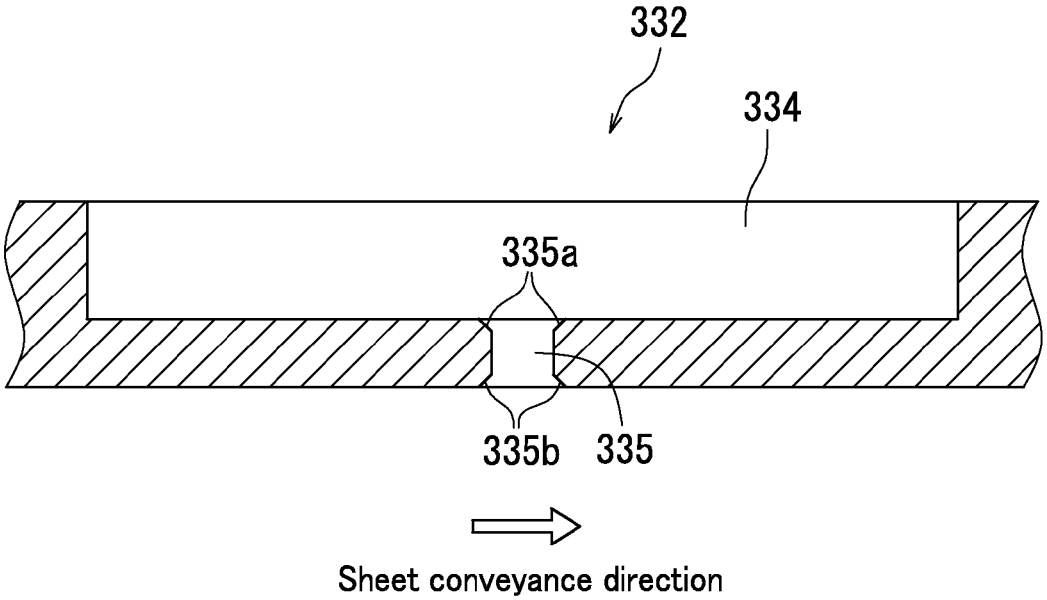
FIG. 6B is a sectional view of the groove and the through hole taken along line VIB-VIB shown in FIG. 6A.

Next, a description is given of the grooves 334 and the through holes 335 of the guide member 332 with reference to FIGS. 6A and 6B. FIG. 6A is a plan view showing structure of a groove 334 and a through hole 335 in the guide member 332. FIG. 6B is a sectional view of the groove 334 and the through hole 335 taken along line VIB-VIB shown in FIG. 6A.

As shown in FIG. 6A, the groove 334 has the through hole 335 that penetrates the guide member 332 in the thickness direction thereof substantially at the center of the groove 334 in the conveyance direction of the sheet P (horizontal direction in FIG. 6A). As shown in FIG. 6B, the groove 334 is continuous with the through hole 335, and therefore negative pressure created in the airflow chamber 331 affects an inner region of the groove 334 through the through hole 335. The through hole 335 has a tapered portion 335*a* formed at an upper mouth and a tapered portion 335*b* formed at a lower mouth.

As described above, the grooves 334 are located in a region opposite to the plate member 35. Therefore, negative pressure created in the airflow chamber 331 affects the inner regions of the grooves 334 through the through holes 335. This further facilitates flow of air along the paths indicated by the arrows FD1 and FD2 shown in FIG. 3. Consequently, more effective removal of paper dust is enabled.

As described above, in addition, the tapered portion 335*a* at the upper mouth and the tapered portion 335*b* at the lower mouth of each through hole 335 are effective to reduce pressure loss of air flowing through the through hole 335. This further facilitates flow of air along the paths indicated by the arrows FD1 and FD2 shown in FIG. 3. Consequently, more effective removal of paper dust is enabled.

The present embodiment is directed to a configuration in which each through hole 335 has both the tapered portions 335*a* and 335*b* respectively at the upper mouth and the lower mouth. Alternatively, however, each through hole 335 may have one tapered portion at either the upper or lower mouth.

Reference is made again to FIG. 4, and a description is given of the relative positions of the suction holes 321 in the conveyor belt 32 and the grooves 334 in the guide member 332. The conveyor belt 32 has the suction holes 321 arranged in a plurality of rows in the conveyance direction of the sheet P. The rows of suction holes 321 are next to one another in the width direction of the conveyor belt 32 (direction perpendicular to the conveyance direction of the sheet P) such that the suction holes 321 in adjacent rows are staggered. As shown in FIG. 4, in addition, the respective rows of the suction holes 321 in the conveyor belt 32 are located opposite to the rows of the grooves 334 in the guide member 332.

Each groove 334 is arranged so as to be opposite to at least two of the suction holes 321 at all times. The suction holes 321 that are opposite to the grooves 334 change one-by-one as the conveyor belt 32 circulates.

The airflow chamber 331, which is under negative pressure created by the negative pressure creating section 336, is in communication with the suction holes 321 in the conveyor belt 32 through the through holes 335 and the grooves 334 of the guide member 332.

Therefore, negative pressure is applied to the suction holes 321 of the conveyor belt 32 and thus the conveyor belt 32 can convey a sheet P with the sheet P sucked onto the conveyor belt 32.

<Embodiment Provided with Shield Plates>

Figure 7A:
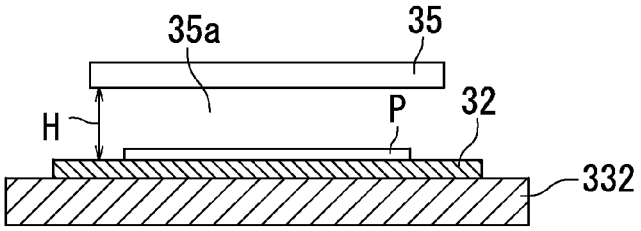
FIG. 7A is a front sectional view showing a configuration not provided with shield plates that obstruct air flowing laterally inward of the plate member shown in FIG. 2.
Figure 7B:
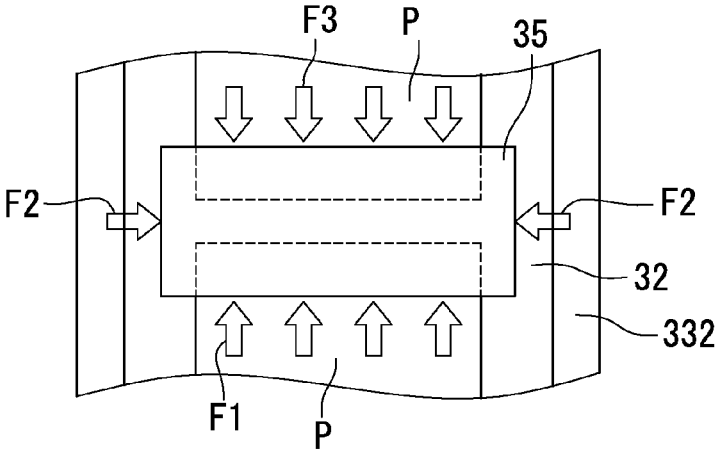
FIG. 7B is a plan view of the configuration not provided with the shield plates.

With reference to FIGS. 7A to 10C, a description is given of an embodiment provided with shield plates 381 (382 or 383). The shield plates 381 obstruct air flowing laterally into the narrow gap 35*a* shown in FIG. 2. With reference to FIGS. 7A to 7D, a description is given of difference between a configuration provided with the shield plates 381 and a configuration without the shield plates 381. FIG. 7A is a front sectional view showing the configuration without the shield plates 381. FIG. 7B is a plan view showing the configuration without the shield plates 381. FIG. 7C is a front sectional view showing the configuration provided with the shield plates 381. FIG. 7D is a plan view showing the configuration provided with the shield plates 381.

As shown in FIG. 7A, the narrow gap 35*a* between the plate member 35 and the conveyor belt 32 is open in the conveyance direction of the sheet P (direction perpendicular to the drawing surface of FIG. 7A) and also open in the lateral direction (the horizontal direction of the plate member 35 in FIG. 7A). Consequently, in addition to airflow F1 and airflow F3 flowing into the narrow gap 35*a* in the conveyance direction of the sheet P (vertical direction in FIG. 7B) and airflow F2 flows into the narrow gap 35*a* in the direction perpendicular to the conveyance direction of the sheet P (horizontal direction in FIG. 7B). The airflow F2 collides with the airflow F1 and the airflow F3 to reduce the flow velocity of the airflow F1 and the airflow F3. This weakens the airflow F1 and the airflow F3 and thus reduces efficiency of paper dust removable.

Figure 7C:
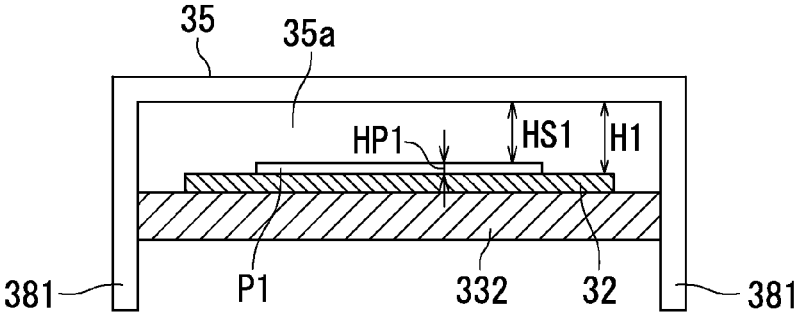
FIG. 7C is a front sectional view showing a configuration provided with the shield plates.

As shown in FIG. 7C, the two shield plates 381 are integral with the plate member 35. The plate member 35 extends outward beyond opposite edges of the guide member 332 in the width direction of the plate member 35 (horizontal direction in FIG. 7C). The two shield plates 381 extend vertically downward from the widthwise edges of the plate member 35 in order to obstruct air flowing laterally into the narrow gap 35*a* in the width direction of the narrow gap 35*a*. The two shield plates 381 are one example of a "shielding section".

The efficiency of obstructing air flowing laterally into the narrow gap 35*a* increases with a decreasing distance between each of the shield plates 381 and a corresponding one of widthwise edges of the guide member 332. Preferably, the two shield plates 381 are each arranged to minimize the distance to the corresponding widthwise edge of the guide member 332.

Figure 7D:
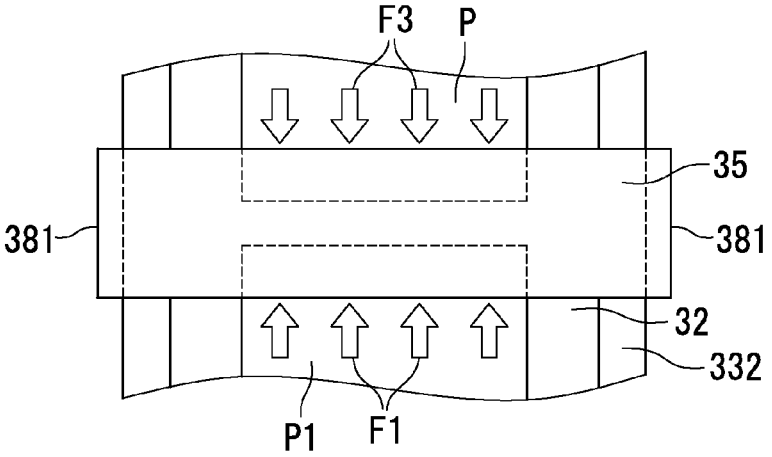
FIG. 7D is a plan view showing the configuration provided with the shield plates.

The two shield plates 381 arranged as shown in FIG. 7C obstruct air flowing into the narrow gap 35*a* from the direction perpendicular to the conveyance direction of the sheet P as shown in FIG. 7D. That is, the two shield plates 381 obstruct the airflow F2, thereby allowing the airflow F1 and the airflow F3 in the conveyance direction of the sheet P to have a higher flow velocity. This can increase efficiency of paper dust removal.

The two shield plates 381 shown in FIG. 7C are each equal in length to the plate member 35 in the conveyance direction of the sheet P (vertical direction in FIG. 7D) as shown in FIG. 7D. This, however, should not be construed as limiting. The two shield plates 381 may differ in length from the plate member 35 in the conveyance direction of the sheet P. For example, the two shield plates 381 may be longer than the plate member 35 in the conveyance direction of the sheet P. The longer shield plates 381 can further obstruct the airflow F2 and thus further improve efficiency of paper dust removal by the airflow F1 and the airflow F3. In a preferable configuration to further obstruct the airflow F2, the two shield plates 381 each extend beyond the upstream and downstream edges of the plate member 35 in the conveyance direction of the sheet P.

Figure 8A:
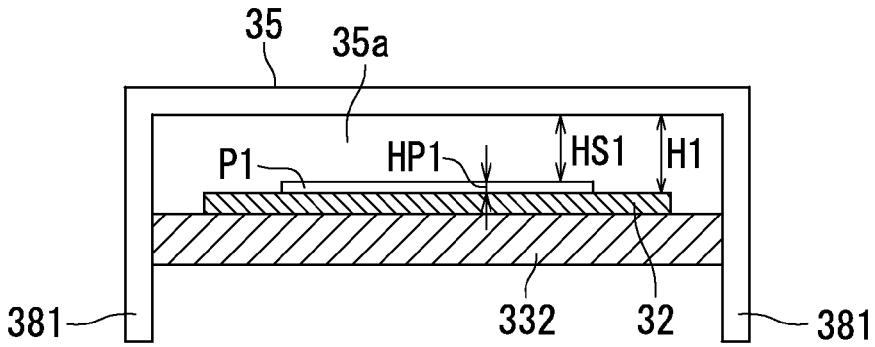
FIGS. 8A to 8C are each a front sectional view illustrating movement of the shield plates shown in FIGS. 7C and 7D according to an embodiment (first embodiment)
Figure 8B:
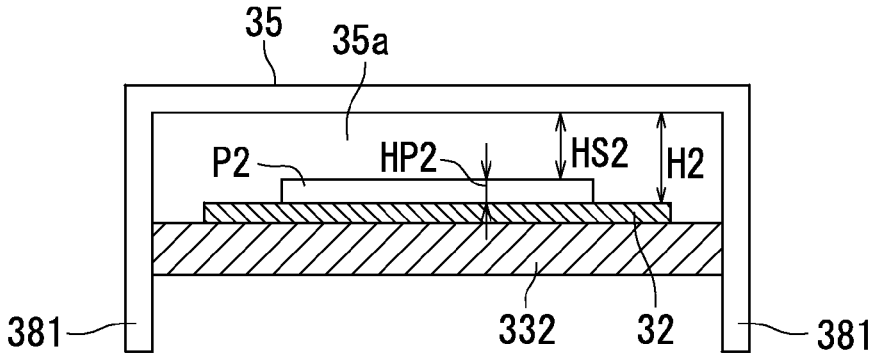
Figure 8C:
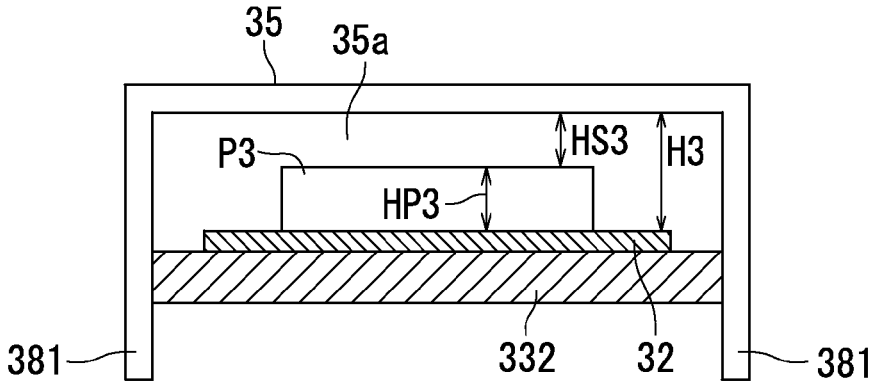

Next, a description is given of movement of the plate member 35 and the two shield plates 381 with reference to FIGS. 8A to 8C. FIGS. 8A to 8C are each a front sectional view showing movement of the two shield plates 381 shown in FIGS. 7C and 7D according to an embodiment (first embodiment). FIG. 8A shows a state in which a sheet P is standard paper P1. FIG. 8B shows a state in which a sheet P is thick paper P2. FIG. 8C shows a state in which a sheet P is an envelope P3. The plate member 35 and the two shield plates 381 are movable up and down by a motor not shown in the figures.

For a sheet P that is standard paper P1 as shown in FIG. 8A, the vertical positions of the plate member 35 and the two shield plates 381 are set such that a distance HS1 between the lower surface of the plate member 35 and the upper surface of the standard paper P1 is equal to a distance HA that is set in advance. The standard paper P1 has a thickness HP1 of, for example, 0.1 mm. The distance HA is, for example, 2.0 mm. Specifically, the vertical positions of the plate member 35 and the two shield plates 381 are set such that a distance H1 between the lower surface of the plate member 35 and the upper surface of the conveyor belt 32 measures 2.1 mm.

For a sheet P that is thick paper P2 as shown in FIG. 8B, the vertical positions of the plate member 35 and the two shield plates 381 are set such that a distance HS2 between the lower surface of the plate member 35 and the upper surface of the thick paper P2 is equal to the distance HA that is set in advance. The thick paper P2 has a thickness HP2 of, for example, 0.5 mm. Specifically, the vertical positions of the plate member 35 and the two shield plates 381 are set such that a distance H2 between the lower surface of the plate member 35 and the upper surface of the conveyor belt 32 measures 2.5 mm.

For a sheet P that is an envelope P3 as shown in FIG. 8C, the vertical positions of the plate member 35 and the two shield plates 381 are set such that a distance HS3 between the lower surface of the plate member 35 and the upper surface of the envelope P3 is equal to the distance HA that is set in advance. The envelope P3 has a thickness HP3 of, for example, 1.0 mm. Specifically, the vertical positions of the plate member 35 and the two shield plates 381 are set such that a distance H3 between the lower surface of the plate member 35 and the upper surface of the conveyor belt 32 measures 3.0 mm.

As described above, the plate member 35 is lifted up and down according to the thickness of the sheet P so as to ensure the distance HA between the lower surface of the plate member 35 and the upper surface of the sheet P. The plate member 35 can therefore be positioned appropriately according to the thickness of the sheet P. Consequently, paper dust attached to the sheet P can be effectively removed for a variety of thicknesses that the sheet P may have.

In addition, as the plate member 35 is lifted up and down according to the thickness of the sheet P, the two shield plates 381 integral with the plate member 35 move up and down as shown in FIGS. 8A to 8C. The two shield plates 381 have a sufficient vertical length (the length in the vertical direction in FIGS. 8A to 8C) for obstructing air flowing into the narrow gap 35*a* from the direction perpendicular to the conveyance direction of the sheet P (horizontal direction in FIGS. 8A to 8C) at any vertical position set according to the thickness of the sheet P.

In other words, the vertical length of the two shield plates 381 is set to be sufficient to obstruct air flowing into the narrow gap 35*a* from the direction perpendicular to the conveyance direction of the sheet P in a situation in which the sheet P loaded into the sheet feed cassette 21 and targeted for printing has a maximum thickness printable by the inkjet recording apparatus 1 shown in FIG. 1 (for example, envelope P3 having a thickness of 1.0 mm).

The above configuration ensures obstruction of air flowing into the narrow gap 35*a* from the direction perpendicular to the conveyance direction of the sheet P for a variety of thicknesses that the sheet P may have. This can ensure effective removal of paper dust.

The vertical positions of the plate member 35 and the two shield plates 381 are set according to the thickness of sheet P when, for example, the thickness of a sheet P targeted for printing is changed. A section related to settings of vertical positions of the plate member 35 and the two shield plates 381 to accommodate the change in thickness of the sheet P is an example of a "distance setting section". The thickness of the sheet P may for example be input to the inkjet recording apparatus 1 shown in FIG. 1 in the following manner. That is, when a user loads a sheet P into the sheet feed cassette 21 shown in FIG. 1, the user may operate an operation panel (not shown) to input the thickness of the sheet P.

Figure 9A:
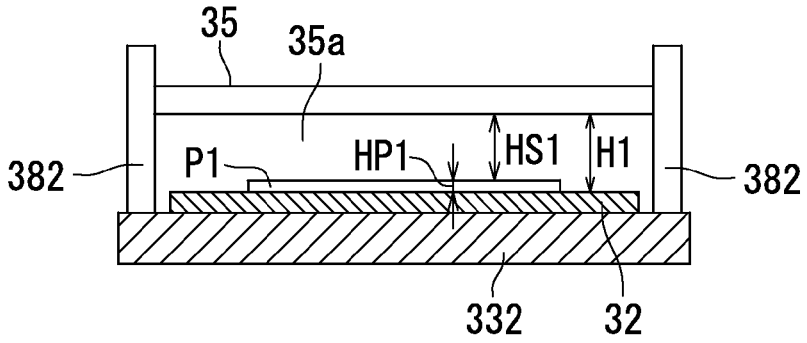
FIGS. 9A to 9C are each a front sectional view illustrating movement of the shield plates shown in FIGS. 7C and 7D according to another embodiment (second embodiment)
Figure 9B:
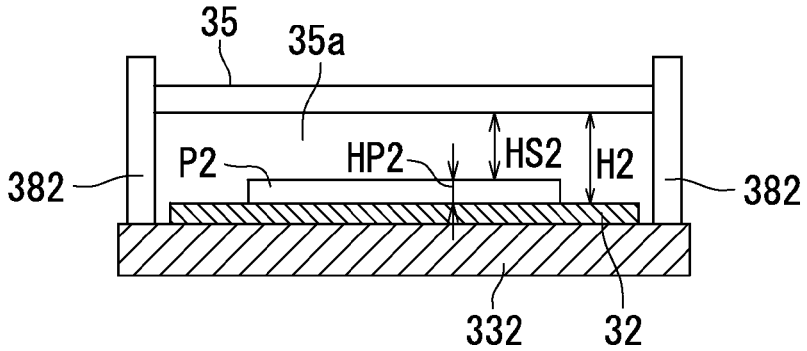
Figure 9C:
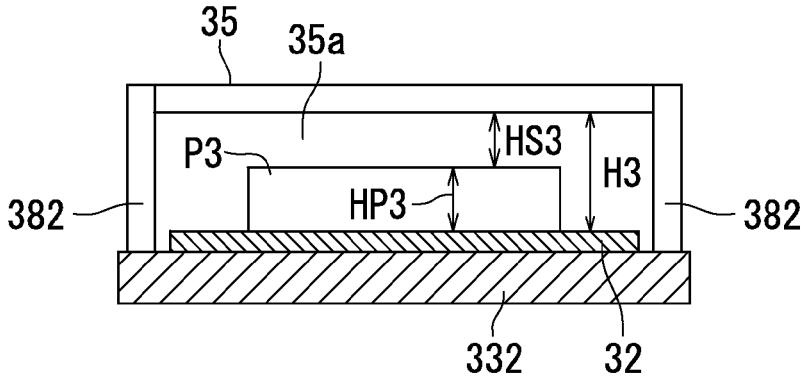

With reference to FIGS. 9A to 9C, a description is given of another embodiment (second embodiment) of the shield plates 381 shown in FIGS. 7C and 7D. Shield plates 382 according to the second embodiment differ from the shield plates 381 according to the first embodiment in that the shield plates 382 upstand from the guide member 332. FIGS. 9A to 9C are each a front sectional view showing the shield plates 382 according to the second embodiment. FIG. 9A shows a state in which the sheet P is standard paper P1. FIG. 9B shows a state in which the sheet P is thick paper P2. FIG. 9C shows a state in which the sheet P is an envelope P3.

First, a description is given of structure of the shield plates 382 according to the second embodiment with reference to FIG. 9A. As shown in FIG. 9A, the two shield plates 382 upstand from opposite ends of the guide member 332 in the width direction (horizontal direction in FIG. 9A) and in close proximity to opposite edges of the plate member 35 in the width direction of the plate member 35. The plate member 35 extends outward beyond the widthwise edges of the conveyor belt 32. The two shield plates 382 upstanding from opposite ends of the guide member 332 in the width direction of the guide member 332 obstruct air flowing laterally into the narrow gap 35*a* in the width direction of the narrow gap 35*a*. The two shield plates 382 are one example of the "shielding section". The plate member 35 is movable up and down by a motor (not shown).

As shown in FIG. 9A, the two shield plates 382 are provided to obstruct air flowing into the narrow gap 35*a* from the direction perpendicular to the conveyance direction of the sheet P. In other words, the two shield plates 382 obstruct air flowing from the direction perpendicular to the conveyance direction of the sheet P. This allows air flowing in the conveyance direction of the sheet P to have a higher flow velocity and thus improve the efficiency of paper dust removal.

For a sheet P that is standard paper P1 as shown in FIG. 9A, the vertical position of the plate member 35 is set such that a distance HS1 between the lower surface of the plate member 35 and the upper surface of the standard paper P1 is equal to the distance HA that is set in advance. The standard paper P1 has a thickness HP1 of, for example, 0.1 mm. The distance HA is, for example, 2.0 mm. Specifically, the vertical position of the plate member 35 is set such that a distance H1 between the lower surface of the plate member 35 and the upper surface of the conveyor belt 32 measures 2.1 mm.

For a sheet P that is thick paper P2 as shown in FIG. 9B, the vertical position of the plate member 35 is set such that a distance HS2 between the lower surface of the plate member 35 and the upper surface of the thick paper P2 is equal to the distance HA that is set in advance. The thick paper P2 has a thickness HP2 of, for example, 0.5 mm. Specifically, the vertical position of the plate member 35 is set such that a distance H2 between the lower surface of the plate member 35 and the upper surface of the conveyor belt 32 measures 2.5 mm.

For a sheet P that is an envelope P3 as shown in FIG. 9C, the vertical position of the plate member 35 is set such that a distance HS3 between the lower surface of the plate member 35 and the upper surface of the envelope P3 is equal to the distance HA that is set in advance. The envelope P3 has a thickness HP3 of, for example, 1.0 mm. Specifically, the vertical position of the plate member 35 is set such that a distance H3 between the lower surface of the plate member 35 and the upper surface of the conveyor belt 32 measures 3.0 mm.

As described above, the plate member 35 is lifted up and down according to the thickness of the sheet P so as to have the distance HA between the lower surface of the plate member 35 and the upper surface of the sheet P. The plate member 35 can therefore be positioned appropriately according to the thickness of the sheet P. Consequently, paper dust attached to the sheet P can be effectively removed for a variety of thicknesses that the sheet P may have.

The two shield plates 382 each have a sufficient vertical length (the length in the vertical direction in FIGS. 9A to 9C) for obstructing air flowing into the narrow gap 35*a* from the direction perpendicular to the conveyance direction of the sheet P (horizontal direction in FIGS. 9A to 9C) at any vertical position set according to the thickness of the sheet P.

In other words, the vertical length of the two shield plates 382 is set to be sufficient to obstruct air flowing into the narrow gap 35*a* from the direction perpendicular to the conveyance direction of the sheet P in a situation in which the sheet P loaded into the sheet feed cassette 21 and targeted for printing has a maximum thickness printable by the inkjet recording apparatus 1 shown in FIG. 1 (for example, envelope P3 having a thickness of 1.0 mm).

The above configuration ensures obstruction of air flowing into the narrow gap 35*a* from the direction perpendicular to the conveyance direction of the sheet P for a variety of thicknesses that the sheet P may have. This can ensure effective removal of paper dust.

FIGS. 9A to 9C show a configuration in which the two shield plates 382 are located in proximity to opposite edges of the plate member 35 in the width direction (the horizontal direction in FIG. 9A) of the plate member 35. This, however, should not be construed as limiting. The two shield plates 382 may be in abutment against the widthwise edges of the plate member 35. In this configuration, a lateral surface of each of the two shield plates 382 slides along a corresponding one of the widthwise edges of the plate member 35 as the plate member 35 is lifted up and down. This configuration can ensure more effective obstruction of air flowing into the narrow gap 35*a* from the direction perpendicular to the conveyance direction of the sheet P and thus ensure more effective removal of paper dust.

Figure 10A:
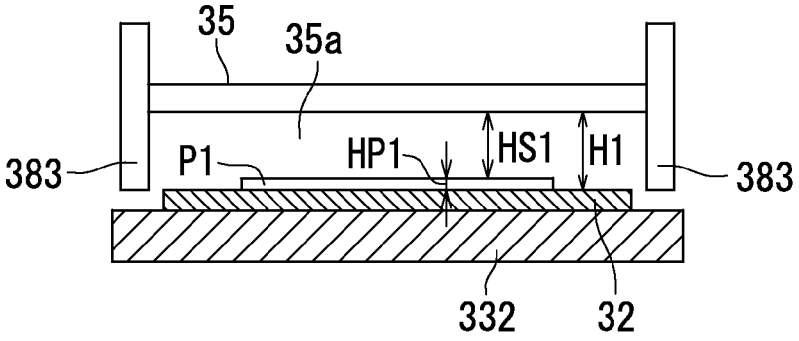
FIGS. 10A to 10C are each a front sectional view illustrating movement of the shield plate shown in FIGS. 7C and 7D according to a yet another embodiment (third embodiment)
Figure 10B:
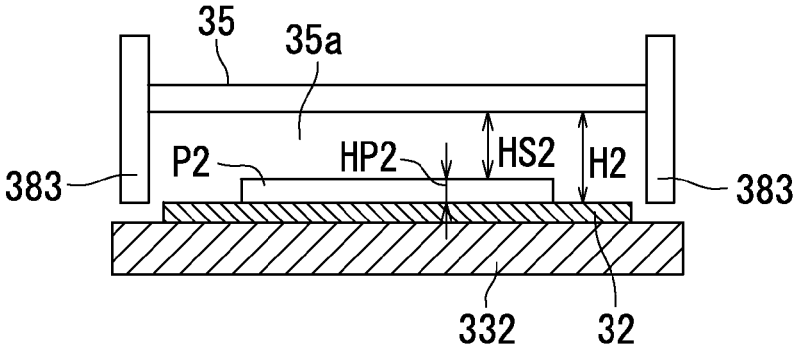
Figure 10C:
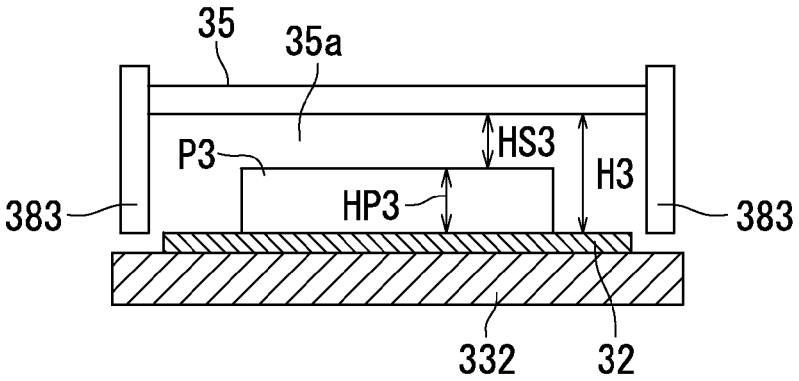

With reference to FIGS. 10A to 10C, a description is given of a yet another embodiment (third embodiment) of the shield plates 381 shown in FIGS. 7C and 7D. Shield plates 383 according to the third embodiment differ from the shield plates 381 according to the first embodiment in that the shield plates 383 are secured in place at locations outward of the conveyor belt 32 in the width direction of the conveyor belt 32. In addition, the shield plates 383 according to the third embodiment differ from the shield plates 382 according to the second embodiment in that that the shield plates 383 do not upstand from the widthwise ends of the guide member 332 (the lower end of each shield plate 383 is spaced above the guide member 332). FIGS. 10A to 10C are each a front sectional view of the third embodiment of the shield plates 383 shown in FIGS. 7C and 7D. FIG. 10A shows a state in which the sheet P is standard paper P1. FIG. 10B shows a state in which the sheet P is thick paper P2. FIG. 10C shows a state in which the sheet P is an envelope P3.

First, a description is given of structure of the shield plates 383 according to the third embodiment with reference to FIG. 10A. As shown in FIG. 10A, the two shield plates 383 are each secured in place at a location above and outward of the conveyor belt 32 in the width direction of the conveyor belt 32 such that the shield plates 383 are located in proximity to opposite edges of the plate member 35 in the width direction (the horizontal direction in FIG. 10A) of the plate member 35. Specifically, the two shield plates 383 are secured, for example, to the head base 37 (see FIG. 3). The plate member 35 extends outward beyond the conveyor belt 32 in the width direction of the conveyor belt 32. The two shield plates 383 are secured to the head base 37 at locations outward of the conveyor belt 32 in the width direction of the conveyor belt 32 in order to obstruct air flowing laterally into the narrow gap 35*a* in the width direction of the narrow gap 35*a*. The two shield plates 383 are one example of the "shielding section". The plate member 35 is movable up and down by a motor (not shown).

As shown in FIG. 10A, the two shield plates 383 are provided to obstruct air flowing into the narrow gap 35*a* from the direction perpendicular to the conveyance direction of the sheet P. In other words, the two shield plates 383 obstruct air flowing from the direction perpendicular to the conveyance direction of the sheet P. This allows air flowing in the conveyance direction of the sheet P to have a higher flow velocity and thus improve the efficiency of paper dust removal.

For a sheet P that is standard paper P1 as shown in FIG. 10A, the vertical position of the plate member 35 is set such that a distance HS1 between the lower surface of the plate member 35 and the upper surface of the standard paper P1 is equal to the distance HA that is set in advance. The standard paper P1 may have a thickness HP1 of, for example, 0.1 mm. The distance HA is, for example, 2.0 mm. Specifically, the vertical position of the plate member 35 is set such that a distance H1 between the lower surface of the plate member 35 and the upper surface of the conveyor belt 32 measures 2.1 mm.

For a sheet that is thick paper P2 as shown in FIG. 10B, the vertical position of the plate member 35 is set such that a distance HS2 between the lower surface of the plate member 35 and the upper surface of the thick paper P2 is equal to the distance HA that is set in advance. The thick paper P2 has a thickness HP2 of, for example, 0.5 mm. Specifically, the vertical position of the plate member 35 is set such that a distance H2 between the lower surface of the plate member 35 and the upper surface of the conveyor belt 32 measures 2.5 mm.

For a sheet P that is an envelope P3 as shown in FIG. 10C, the vertical position of the plate member 35 is set such that a distance HS3 between the lower surface of the plate member 35 and the upper surface of the envelope P3 is equal to the distance HA that is set in advance. The envelope P3 may have a thickness HP3 of, for example, 1.0 mm. Specifically, the vertical position of the plate member 35 is set such that a distance H3 between the lower surface of the plate member 35 and the upper surface of the conveyor belt 32 measures 3.0 mm.

As described above, the plate member 35 is lifted up and down according to the thickness of the sheet P so as to have the distance HA between the lower surface of the plate member 35 and the upper surface of the sheet P. The plate member 35 can therefore be positioned appropriately according to the thickness of the sheet P. Consequently, paper dust attached to the sheet P can be effectively removed for a variety of thicknesses that the sheet P may have.

In addition, the two shield plates 383 each have a vertical length (the length in the vertical direction in FIGS. 10A to 10C) and a vertical position sufficient to obstruct air flowing into the narrow gap 35*a* from the direction perpendicular to the conveyance direction of the sheet P (horizontal direction in FIGS. 10A to 10C) at any vertical position set according to the thickness of the sheet P.

In other words, the vertical position and the vertical length of each the two shield plates 383 are set to be sufficient to obstruct air flowing into the narrow gap 35*a* from the direction perpendicular to the conveyance direction of the sheet P in a situation in which the sheet P loaded into the sheet feed cassette 21 and targeted for printing has a maximum thickness printable by the inkjet recording apparatus 1 shown in FIG. 1 (for example, envelope P3 having a thickness of 1.0 mm). In addition, the vertical position and the vertical length of each of the two shield plates 383 are set to be sufficient to obstruct air flowing into the narrow gap 35*a* from the direction perpendicular to the conveyance direction of the sheet P in a situation in which the sheet P loaded into the sheet feed cassette 21 and targeted for printing has a minimum thickness printable by the inkjet recording apparatus 1 shown in FIG. 1 (for example, standard paper P1 having a thickness of 0.1 mm).

The above configuration can obstruct air flowing into the narrow gap 35*a* from the direction perpendicular to the conveyance direction of the sheet P for a variety of thicknesses that the sheet P may have. Consequently, paper dust can be removed more effectively.

FIGS. 10A to 10C are used to explain a configuration in which the two shield plates 383 are located in proximity to opposite edges of the plate member 35 in the width direction (horizontal direction in FIG. 10A). This, however, should not be construed as limiting. The two shield plates 383 may be in abutment against the widthwise edges of the plate member 35. In this configuration, a lateral surface of each of the two shield plates 383 slides along a corresponding one of the widthwise edges of the plate member 35 as the plate member 35 is lifted up and down. This configuration can more effectively obstruct air flowing into the narrow gap 35*a* from the direction perpendicular to the conveyance direction of the sheet P. Consequently, paper dust can be removed more effectively.

<Embodiment Provided with Air Blower>

Figure 11:
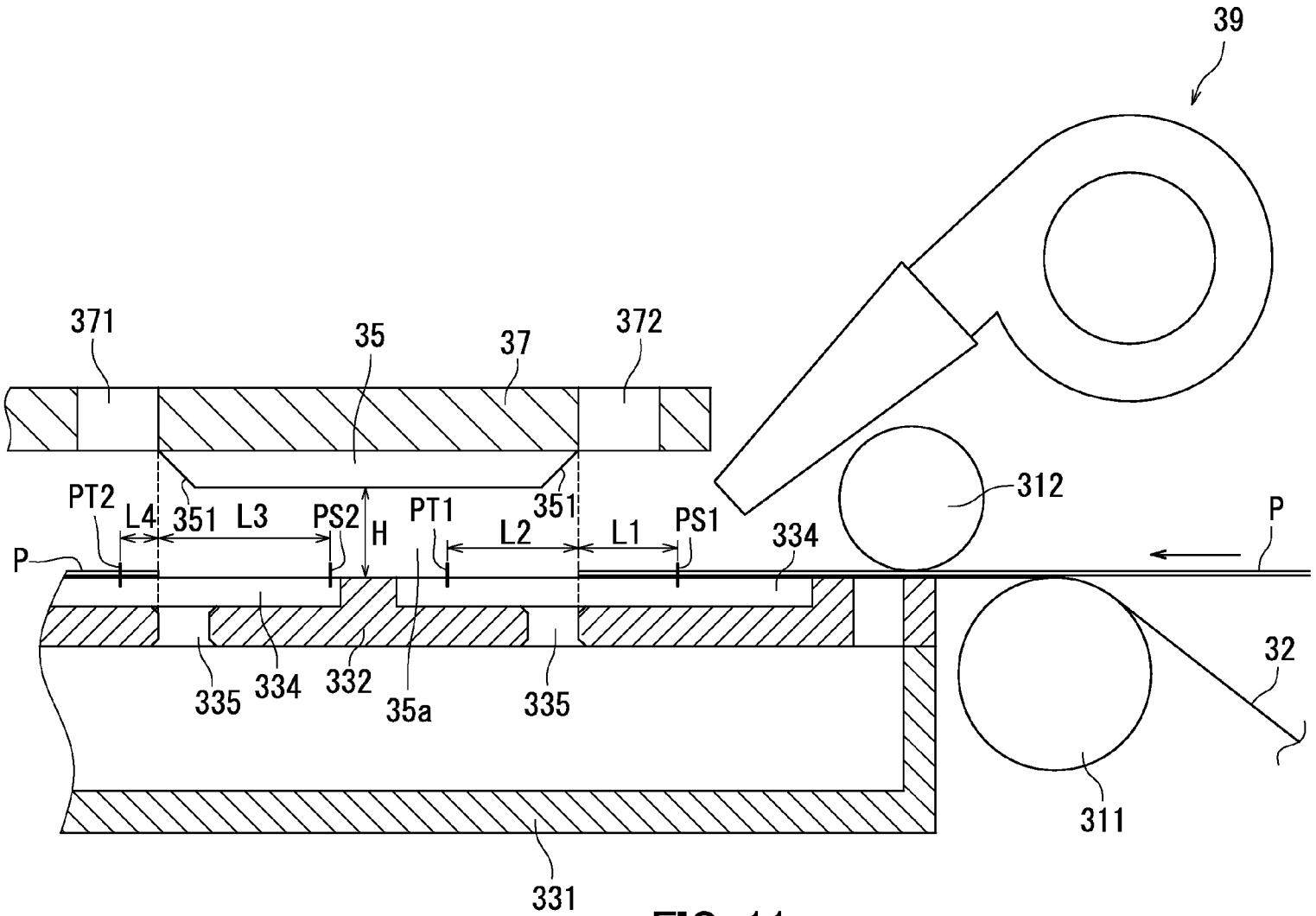
FIG. 11 shows structure around the plate member in a configuration provided with an air blower for blowing air into a narrow gap shown in FIG. 3.
Figure 12A:
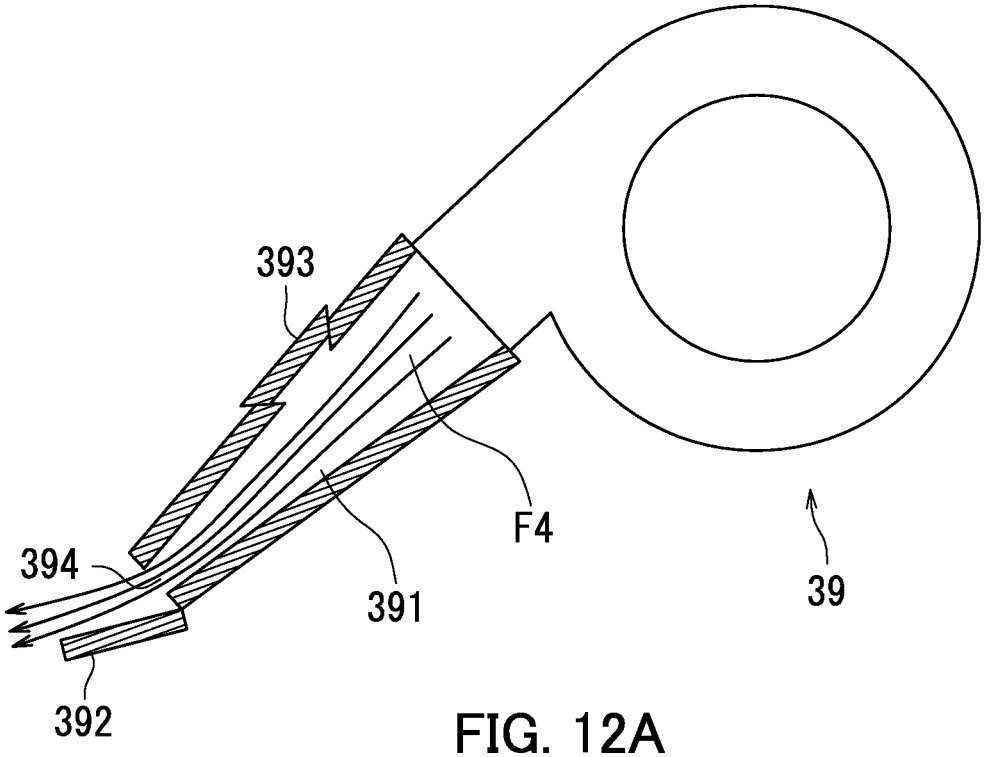
FIGS. 12A and 12B each show structure and operation of the air blower shown in FIG. 11.
Figure 12B:
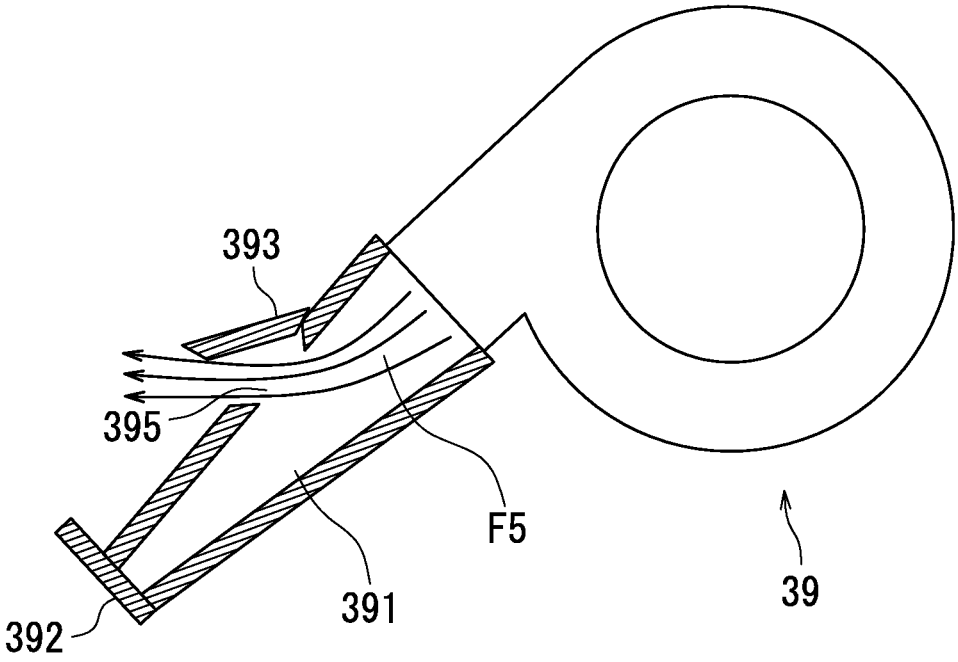
Figure 13:
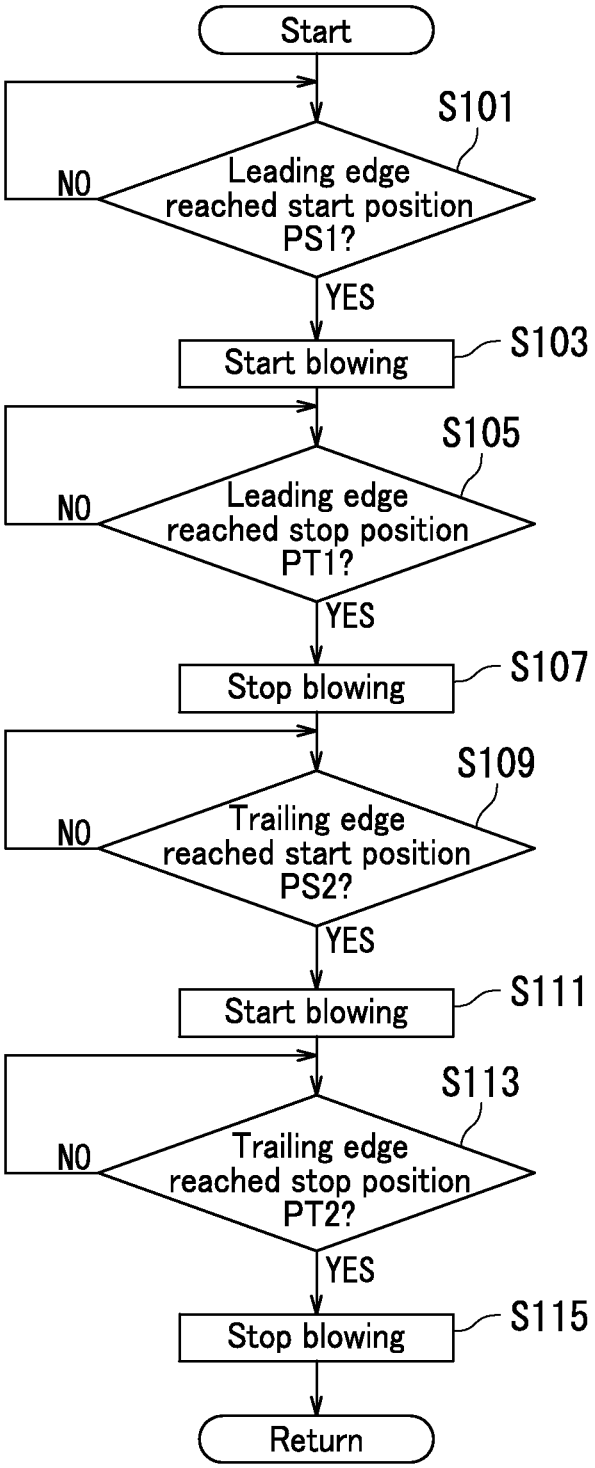
FIG. 13 is a flowchart of operation of the air blower shown in FIG. 11.

With reference to FIGS. 11 to 13, a description is given of an embodiment provided with an air blower (air blowing section) 39. First, with reference to FIG. 11, a description is given of the arrangement of the air blower 39. FIG. 11 shows structure around the plate member 35 in a configuration in which the air blower 39 is provided. The air blower 39 is located upstream of the plate member 35 in the sheet conveyance direction and blows air into the narrow gap 35*a*. The air blower 39 includes a fan (not shown) and blows air created by the fan toward the narrow gap 35*a*.

Next, with reference to FIGS. 12A and 12B, a description is given of structure and operation of the air blower 39. FIGS. 12A and 12B each show structure and operation of the air blower 39 shown in FIG. 11. FIG. 12A shows a state in which the air blower 39 is blowing air. FIG. 12B shows a state in which the blowing air is suspended. As shown in FIG. 12A, the air blower 39 includes a blower chamber 391, a blower valve 392, an exhaust valve 393, a blower outlet 394, and a gas outlet 395. FIGS. 12A and 12B omit a wall surface of the blower chamber 391 located at a near side in the figures to provide clear illustration of opening and closing of the exhaust valve 393 and the blower valve 392.

The blower chamber 391 is a space for confining air blown from the fan (not shown). The blower chamber 391 has the blower outlet 394 at a location (lower left in FIG. 12A) opposite to the fan (not shown). The blower outlet 394 is an opening though which air from the fan passes toward the narrow gap 35*a* shown in FIG. 11. The blower chamber 391 is constricted from a location of the fan (upper right in FIGS. 12A and 12B) toward the blower outlet 394. Therefore, the blower chamber 391 has a larger cross sectional area at a location closer to the fan than at a location closer to the blower outlet 394. The gas outlet 395 is an opening formed in a lateral surface of the blower chamber 391 so as to allow air to exit from the blower chamber 391. The exhaust valve 393 is switched to the open position to allow discharge of air from the blower chamber 391. The blower valve 392 opens and closes the blower outlet 394.

While the air blower 39 is blowing air, the blower valve 392 is in the open position and the exhaust valve 393 is in the closed position as shown in FIG. 12A. Since the exhaust valve 393 is in the closed position, air from the fan (not shown) is confined in the blower chamber 391. In addition, since the blower valve 392 is in the open position, air confined in the blower chamber 391 blows out through the blower outlet 394 as indicated by arrows F4.

While the air blowing by the air blower 39 is suspended, the blower valve 392 is in the closed position and the exhaust valve 393 is in the open position as shown in FIG. 12B. Since the blower valve 392 is in the closed position, air confined in the blower chamber 391 is not blown out through the blower outlet 394. Since the exhaust valve 393 is in the open position, air blown from the fan (not shown) into the blower chamber 391 is allowed to escape through the gas outlet 395 as indicated by arrows F5.

As described above, the air blower 39 is provided to enable further increase of the flow velocity of air flowing into the narrow gap 35*a* shown in FIG. 11 from upstream in the conveyance direction of the sheet P and thus enable more effective removal of paper dust.

In addition, the blower valve 392 and the exhaust valve 393 enable the air blower 39 to promptly start and stop air blowing toward the narrow gap 35*a*. Consequently, starting and stopping of air blowing by the air blower 39 toward the narrow gap 35*a* can be timed as desired.

With reference to FIG. 13, a description is given of the start timing and the stop timing of the air blower 39 for blowing air toward the narrow gap 35*a*. FIG. 13 is a flowchart of operation of the air blower 39 shown in FIG. 11. The operation shown in FIG. 13 is performed by a controller (not shown) included in the inkjet recording apparatus 1 shown in FIG. 1. The controller is provided with a central processing unit (CPU), read only memory (ROM), and random access memory (RAM). The ROM stores a control program for the air blower 39. The CPU reads and executes the control program from the ROM to implement various functional units including those relevant to operation control of the air blower 39. The RAM is used by the CPU as a work area for execution of the control program.

First, a determination is made as to whether or not the leading edge of a sheet P has reached a blow start position PS1 (see FIG. 11) (Step 101). The wording "leading edge of the sheet P" refers to an edge of the sheet P located downstream in the conveyance direction of the sheet P. In one example, the blow start position PS1 is a predetermined distance L1 (for example, 10 mm) upstream from the most upstream location within the narrow gap 35*a* in the conveyance direction of the sheet P. On determining that the leading edge of the sheet P has not reached the blow start position PS1 (Step S101, NO), the controller waits in standby. On determining that the leading edge of the sheet P has reached the blow start position PS1 (Step S101, YES), the controller causes the air blower 39 to start blowing air (Step S103).

Next, a determination is made as to whether or not the leading edge of the sheet P has reached a blow stop position PT1 (see FIG. 11) (Step S105). In one example, the blow stop position PT1 is a predetermined distance L2 (for example, 20 mm) downstream from the most upstream location within the narrow gap 35*a* in the conveyance direction of the sheet P. On determining that the leading edge of the sheet P has not reached the blow stop position PT1 (Step S105, NO), the controller waits in standby. On determining that the leading edge of the sheet P has reached the blow stop position PT1 (Step S105, YES), the controller causes the air blower 39 to stop blowing air (Step S107).

Next, a determination is made as to whether or not the trailing edge of the sheet P has reached a blow start position PS2 (see FIG. 11) (Step 109). The wording "trailing edge of the sheet P" refers to an edge of the sheet P located upstream in the conveyance direction of the sheet P. In one example, the blow start position PS2 is a predetermined distance L3 (for example, 20 mm) upstream from the most downstream location within the narrow gap 35*a* in the conveyance direction of the sheet P. On determining that the trailing edge of the sheet P has not reached the blow start position PS2 (Step S109, NO), the controller waits in standby. On determining that the trailing edge of the sheet P has reached the blow start position PS2 (Step S109, YES), the controller causes the air blower 39 to start blowing air (Step S111).

Next, a determination is made as to whether or not the trailing edge of the sheet P has reached a blow stop position PT2 (see FIG. 11) (Step S113). In one example, the blow stop position PT2 is a predetermined distance L4 (for example, 5 mm) downstream from the most downstream location within the narrow gap 35*a* in the conveyance direction of the sheet P. On determining that the trailing edge of the sheet P has not reached the blow stop position PT2 (Step S113, NO), the controller waits in standby. On determining that the trailing edge of the sheet P has reached the blow stop position PT2 (Step S113, YES), the controller causes the air blower 39 to stop blowing air (Step S115). Then, the processing returns to Step S101.

As described above, the air blower 39 blows air upon entry of the leading edge of the sheet P into the narrow gap 35*a*. This enables effective removal of paper dust attached to the leading edge of the sheet P. The air blower 39 blows air also upon exit of the trailing edge of the sheet P from the narrow gap 35*a*. This enables effective removal of paper dust attached to the trailing edge of the sheet P.

The flowchart shown in FIG. 13 is directed to a configuration in which the air blower 39 blows air upon entry of the leading edge of the sheet P into the narrow gap 35*a* and upon exit of the trailing edge of the sheet P from the narrow gap 35*a*. This, however, should not be construed as limiting. The air blower 39 may blow air only upon entry of the leading edge of a sheet P into the narrow gap 35*a* or upon exit of the trailing edge of the sheet P from the narrow gap 35*a*.

Alternatively, the air blower 39 blows air in a cleaning procedure, which may be triggered upon completion of a print job, upon start of a sleep mode, or upon power off of the inkjet recording apparatus 1. In this example, paper dust can be effectively removed from the plate member 35 or the conveyor belt 32 before execution of the cleaning procedure. During the cleaning procedure, it is preferable that the conveyor belt 32 rotates and the negative pressure creating section 336 (see FIG. 2) creates negative pressure in the airflow chamber 331 (see FIG. 2).

The above has described embodiments of the present disclosure with reference to the accompanying drawings. However, the present disclosure is not limited to the specific embodiments described above and can be practiced in various ways within the scope not departing from the essence of the present disclosure (for example, the following (1) to (3)). The drawings are schematic illustrations that emphasize elements of a configuration in order to facilitate understanding thereof. Therefore, in order that the components can be easily illustrated in the drawings, properties of each of the components, such as thickness, distance, and number thereof, may differ from actual properties of the component. The shapes, dimensions, and so on of the components shown in the above-described embodiments are exemplary only and not specific limitations. Variations can be made thereto within the scope not substantially departing from the effect of the present disclosure.

(1) The above embodiments describe a configuration in which the image forming section 3 conveys a sheet P using the conveyor belt 32. This, however, should not be construed as limiting. The image forming section 3 may employ a different method for conveying a sheet P. For example, a plurality of conveyance rollers may be used to convey the sheet P. In this variation, negative pressure is preferably applied through a gap between adjacent conveyance rollers.

(2) The above embodiments describe a configuration in which the narrow gap 35*a* is formed by the plate member 35. This, however, should not be construed as limiting. The narrow gap 35*a* may be formed in another way. For example, the head base 37, which is located upstream of the recording head 34 in the conveyance direction of the sheet P, may be provided with part extending toward the conveyor belt 32 so as to form the narrow gap 35*a*. This variation can simplify the structure.

Alternatively, instead of the plate member 35, a belt stretched around two rollers may be employed to form the narrow gap 35*a*. Specifically, this variation employs a drive roller, a driven roller, and an endless belt in such position that the endless belt stretched around the drive roller and the driven roller is substantially parallel to the upper surface of the conveyor belt 32. The narrow gap 35*a* is formed between the lower surface of the endless belt and the upper surface of the conveyor belt 32. In this variation, once a region of the endless belt located on a lower side is contaminated with paper dust, the endless belt can be rotated to place a region not yet contaminated with paper dust on the lower side. This is effective to reduce the frequency of required paper dust removal from the endless belt by, for example, a service person.

(3) The above embodiments describe a configuration in which the guide member 332 and the airflow chamber 331 are separate components. This, however, should not be construed as limiting. The guide member 332 may be integral with the airflow chamber 331. This variation enables prevention of unintentional release of negative pressure from the airflow chamber (air flowing into the airflow chamber 331 through a gap between the guide member 332 and the airflow chamber 331).

What is claimed is:

1. An inkjet recording apparatus comprising:

a recording head configured to eject ink onto a recording medium;

a conveyance section configured to convey the recording medium to a position of image forming by the recording head, the conveyance section having a conveying surface on which the recording medium is to be placed;

a gap forming section disposed upstream of the recording head in a conveyance direction of the recording medium to form a narrow gap with the conveying surface of the conveyance section; and a negative pressure applying section configured to apply negative pressure to the narrow gap, wherein a distance across the narrow gap in a direction perpendicular to the conveying surface is set so as to allow air flowing into the narrow gap from surrounding space to have a higher flow velocity in the narrow gap than before flowing into the narrow gap, and the conveyance section includes an endless belt having the conveying surface.

2. The inkjet recording apparatus according to claim 1, wherein the gap forming section is disposed to form the narrow gap such that the distance across the narrow gap in the direction perpendicular to the conveying surface is equal to or shorter than a threshold distance that is set in advance.

3. The inkjet recording apparatus according to claim 1, wherein the gap forming section includes a plate member disposed opposite to the conveying surface of the conveyance section and having a flat surface substantially parallel to the conveying surface of the conveyance section.

4. The inkjet recording apparatus according to claim 3, wherein the plate member is an electrical conductor that is earthed.

5. The inkjet recording apparatus according to claim 3, further comprising:

a head base configured to support the recording head, wherein the plate member is secured to the head base, and the head base has a hole located upstream of the plate member in the conveyance direction of the recording medium and another hole located downstream of the plate member in the conveyance direction of the recording medium that allow air to flow into the narrow gap.

6. The inkjet recording apparatus according to claim 3, wherein the plate member includes a tapered portion such that the distance across the narrow gap in the direction perpendicular to the conveying surface is greater toward an edge of the plate member in the conveyance direction of the recording medium.

7. The inkjet recording apparatus according to claim 1, wherein the gap forming section is configured to be movable in the direction perpendicular to the conveying surface.

8. The inkjet recording apparatus according to claim 7, further comprising a distance setting section configured to set the distance across the narrow gap in the direction perpendicular to the conveying surface according to a thickness of the recording medium, wherein the gap forming section is moved in the direction perpendicular to the conveying surface to a position at which the distance across the narrow gap in the direction perpendicular to the conveying surface matches the distance set by the distance setting section.

9. The inkjet recording apparatus according to claim 1, wherein the endless belt has a plurality of holes through which negative pressure created by the negative pressure applying section is applied to suck the recording medium onto the endless belt.

10. The inkjet recording apparatus according to claim 9, wherein the conveyance section includes a conveyor plate configured to support the endless belt, the conveyor plate has a plurality of through holes, and the negative pressure applying section applies negative pressure to the narrow gap through the through holes.

11. The inkjet recording apparatus according to claim 10, wherein each of the through holes includes either or both of a tapered portion formed at an upstream mouth in a direction of airflow and a tapered portion formed at a downstream mouth in the direction of airflow.

12. The inkjet recording apparatus according to claim 10, wherein the conveyor plate has a plurality of grooves each elongated in the conveyance direction of the recording medium and each continuous with one of the through holes at a side toward the endless belt.

13. The inkjet recording apparatus according to claim 1, further comprising:

a shielding section configured to obstruct air flowing laterally into the narrow gap in a width direction of the narrow gap.

14. The inkjet recording apparatus according to claim 13, wherein the conveyance section includes an endless belt on which the recording medium is to be placed and a conveyor plate configured to support the endless belt, the shielding section includes shield plates that are integral with the gap forming section and configured to obstruct air flowing laterally into the narrow gap in the width direction of the narrow gap, and the shield plates are located outward of the conveyor plate in a width direction of the conveyor plate.

15. The inkjet recording apparatus according to claim 13, wherein the conveyance section includes an endless belt on which the recording medium is to be placed and a conveyor plate configured to support the endless belt, the shielding section includes shield plates configured to obstruct air flowing laterally into the narrow gap in the width direction of the narrow gap, and the shield plates upstand from opposite ends of the conveyor plate in a width direction of the conveyor plate.

16. The inkjet recording apparatus according to claim 13, wherein the conveyance section includes an endless belt on which the recording medium is to be placed and a conveyor plate configured to support the endless belt, the shielding section includes shield plates configured to obstruct air flowing laterally into the narrow gap in the width direction of the narrow gap, and the shield plates are secured in place at locations outward of the endless belt in a width direction of the endless belt.

17. The inkjet recording apparatus according to claim 1, further comprising an air blowing section configured to blow air toward the narrow gap from upstream in the conveyance direction of the recording medium.

18. The inkjet recording apparatus according to claim 17, wherein the air blowing section blows air toward the narrow gap from upstream in the conveyance direction of the recording medium, the air blowing being performed either or both upon entry of a leading edge of the recording medium into the narrow gap and upon exit of a trailing edge of the recording medium from the narrow gap.

19. The inkjet recording apparatus according to claim 17, wherein the air blowing section blows air toward the narrow gap from upstream in the conveyance direction of the recording medium, the air blowing section being performed at a time of cleaning of a region in proximity to the narrow gap.

20. The inkjet recording apparatus according to claim 17, wherein the air blowing section includes:

a blower chamber configured to confine air to be blown;

a blower valve configured to open and close a blower outlet of the blower chamber; and an exhaust valve configured to be open during discharge of air from the blower chamber.

* * * * *